US005237369A

United States Patent [19]

Maruta et al.

[11] Patent Number: 5,237,369

[45] Date of Patent: Aug. 17, 1993

[54] COLOR IMAGE FORMING EQUIPMENT RESPONSIVE TO CHANGES IN AMBIENT CONDITIONS

[75] Inventors: Takayuki Maruta; Noboru Sawayama, both of Tokyo; Katsuhiro Aoki, Yokohama, all of Japan

[73] Assignee: Ricoh Company, Ltd., Tokyo, Japan

[21] Appl. No.: 743,252

[22] Filed: Aug. 9, 1991

[30] Foreign Application Priority Data

| | | | |
|---|---|---|---|
| Aug. 10, 1990 | [JP] | Japan | 2-213337 |
| Aug. 10, 1990 | [JP] | Japan | 2-213338 |
| Aug. 20, 1990 | [JP] | Japan | 2-219808 |
| Nov. 2, 1990 | [JP] | Japan | 2-298184 |
| Nov. 13, 1990 | [JP] | Japan | 2-306526 |
| Nov. 13, 1990 | [JP] | Japan | 2-306527 |
| Jun. 20, 1991 | [JP] | Japan | 3-148865 |

[51] Int. Cl.[5] ..... G03G 21/00

[52] U.S. Cl. ..... 355/208; 355/246

[58] Field of Search ..... 355/246, 245, 208, 219, 355/228, 244

[56] References Cited

U.S. PATENT DOCUMENTS

| | | | |
|---|---|---|---|
| 4,179,213 | 12/1979 | Queener . | |
| 4,575,224 | 3/1986 | Arnold . | |
| 4,780,744 | 10/1988 | Porter et al. . | |
| 5,006,896 | 4/1991 | Koichi et al. | 355/246 |

FOREIGN PATENT DOCUMENTS 57-116370 7/1982 Japan .

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

Color image forming equipment capable of immediately responding to a sharp change in environment and producing stable images over a long period of time. An information value relating to the amount of toner deposition on a photoconductive element which changes with a change in environment and effects the formation of an image with a reference value which defines a first and a second environment. Variable dynamic range control devices each being optimal for respective one of the first and second environments are selectively used on the basis of the result of the above comparison.

11 Claims, 26 Drawing Sheets

| |
|---|
| Fig. 24A |
| Fig. 24B |

COLOR IMAGE FORMING EQUIPMENT RESPONSIVE TO CHANGES IN AMBIENT CONDITIONS

BACKGROUND OF THE INVENTION

The present invention relates to color image forming equipment and, more particularly, to a digital color copier of the type using a developer made up of a toner and a carrier, i.e., a two-component developer.

A prerequisite with a digital color copier of the type described is that the toner concentration of the two-component developer be adequately regulated to enhance the reproducibility of tones, especially halftone, of images. To meet this requirement, various toner concentration control methods have heretofore been proposed. The conventional methods may generally be classified into two types, as follows:

Type A: sensing toner concentration or a substitute characteristic and controlling it to a predetermined one; and Type B: sensing the developing ability of a developer or a substitute characteristic and controlling toner concentration such that the developing ability remains constant.

The type A method consists in, for example, detecting changes in the volume density of a developer (Japanese Patent Laid-Open Publication No. 5487/1972), detecting changes in the volume density of a developer in terms of changes in magnetic permeability or reactance (Japanese Patent Laid-Open Publication No. 5138/1972), detecting changes in the volume of a developer (Japanese Patent Laid-Open Publication No. 19459/1975), detecting changes in the volume of a developer in terms of changes in torque (Japanese Patent Laid-Open Publication No. 6598/1972), detecting changes in the tone of a developer (Japanese Patent Laid-Open Publication No. 69527/1973), detecting changes in the electric resistance of a developer (Japanese Patent Laid-Open Publication No. 38157/1973), or detecting a voltage induced by the counter charge (on a carrier) of a developed toner (Japanese Patent Laid-Open Publication Nos. 57638/1973 and 42739/1973). The type B methods include one in which a charge pattern immune to a photoconductive body is formed and then developed to optically sense the density of the resulting toner image.

Such a prior art method, whether it be of type A or type B, cannot satisfactorily reproduce halftone images. Specifically, toner concentration generally changes with the ambient conditions and due to aging. Hence, the type A method which maintains toner concentration constant causes the developing characteristic of the developing to change due to changes in ambient conditions and aging. This type of method, therefore, is not directly applicable to a color copier which attaches importance to the reproducibility of halftone. In the light of this, there have also been proposed a control method which controls the quantity of exposing light by sensing ambient conditions as well as other factors (Japanese Patent Laid-Open Publication No. 177153/1988), and a control method which develops a plurality of potential patterns, optically senses the densities of the resulting toner images, and selects adequate one of exposing potential data which were measured in various environments (Japanese Patent Laid-Open Publication No. 296061/1988). These methods, however, cannot cope with changes in the charging characteristic of a developer due to aging. Although they will be capable of coping with such changes if provided with data covering both the aging and the ambient conditions, preparing such an amount of data is not practical. Moreover, optimizing the developing characteristic by any of the above-mentioned methods is almost impracticable since toner concentration is susceptible to operation modes as well as to aging and ambient conditions.

The type A method is unsatisfactory not only from the standpoint of the above-discussed optimization of developing characteristic but also from the standpoint of adequate toner concentration. Specifically, the limit of toner concentration at which the contamination of background and the scattering of toner sharply increase is also susceptible to changes in ambient conditions and aging. It follows that controlling the toner concentration to a predetermined one as with the type A method is apt to bring about the contamination of background and the scattering of toner due to changes in ambient conditions and aging. As a result, even when the developer is still usable, it is often determined that it should be replaced with a fresh one. Concerning the type B method which so controls the toner concentration as to maintain the developing ability constant, all the changes in the developer ascribable to the environment and aging are fed back to the toner concentration, broadening the range over which the toner concentration is varied. Consequently, the developing ability of the developer is increased in a high humidity environment or in an aged condition. In this condition, should the toner concentration be reduced to control the developing ability to a usual one, the resulting toner concentration would be excessively low to in turn reduce the maximum amount of development, i.e., saturation image density. For this reason, the halftone reproducibility achievable with the type B method is as poor as the type A method.

We have already proposed control methods capable of eliminating the above problems in copending U.S. Pat. application Ser. No. 07/545,508 filed Jun. 29, 1990 and Japanese Patent Application No. 238107/1989. With such methods, it is possible to achieve a stable image density, especially halftone reproducibility, despite the changes in ambient conditions and aging.

However, the problem with the above proposals is that they cannot immediately follow sharp changes in ambient conditions and, therefore, allow the toner concentration to uncontrollably increase due to the excessive supply of toner, failing to insuring a stable image density over a long period of time.

SUMMARY OF THE INVENTION

It is therefore an object of the present invention to provide color image forming equipment capable of insuring a stable image quality over a long period of time by immediately responding to changes in ambient conditions.

It is another object of the present invention to provide color image forming equipment which determines whether or not the quantity of exposing light on a photoconductive element is adequate so as to make the detection conditions for density correction constant and, if the amount of correction needed is extremely great, substitutes the data particular to such a condition for a target value, thereby eliminating the adverse effect otherwise brought about by the correction of the actual density to a target density.

It is another object of the present invention to provide generally improved image forming equipment.

In accordance with the present invention, image forming equipment for electrostatically forming a latent image on an image carrier and developing the latent image by a developer containing at least a toner to produce a corresponding toner image on the image carrier comprises a photosensor for sensing a reflection from a predetermined toner image pattern formed on the image carrier, a first and a second variable dynamic range control device responsive to the output signal of the photosensor for varying at least one of a developing bias, charge potential and amount of exposure to thereby variably control a dynamic range which is a difference between the maximum and minimum values of the surface potential of the image carrier, an outputting unit for outputting an information value relating to the amount of toner deposition on the image carrier which varies with the variation in an ambient condition, a comparing unit for comparing the information value with a reference value which defines a first environment and a second environment, and a switching unit responsive to the output of the comparing unit for selecting either one of the first and second variable dynamic range control devices which are optimal for the first and second environments.

Also, in accordance with the present invention, image forming equipment of the type described comprises a photosensor for sensing a reflection from a predetermined toner image pattern formed on the image carrier, and a controller responsive to the output signal of the photosensor for varying at least one of a developing bias, charge potential, and amount of exposure. The controller shifts, when the amount of toner supply to the developer and the dynamic range for electrostatically forming a latent image on the image carrier are to be controlled in combination in response to the output signal of the photosensor, the developing bias such that the amount of toner deposition on the image carrier becomes constant and, based on the resulted shift, variably controls the dynamic range.

Further, in accordance with the present invention, image forming equipment of the type described comprises a photosensor for sensing a reflection from a predetermined toner image pattern formed on the image carrier, and a controller responsive to the output signal of the photosensor for varying at least one of a developing bias, charge potential, and amount of exposure. The controller determines whether or not the amount of exposure is adequate by determining whether or not a difference between the surface potential of the image carrier and a potential representative of the density of a toner image having been formed by a predetermined density adjustment lies in a predetermined range with respect to a target value, and controls, if the amount of exposure is adequate and if a difference between the output signal of the photosensor responsive to a toner supply control pattern and a predetermined reference output is smaller than a predetermined value, at least one of a charge potential, developing bias and amount of exposure relating to the formation of an image in response to the output signals of the photosensor associated with at least two of the toner image patterns while, if the difference is greater than the predetermined value, controls at least one of the charge potential, developing bias and amount of exposure in matching relation to a target density.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
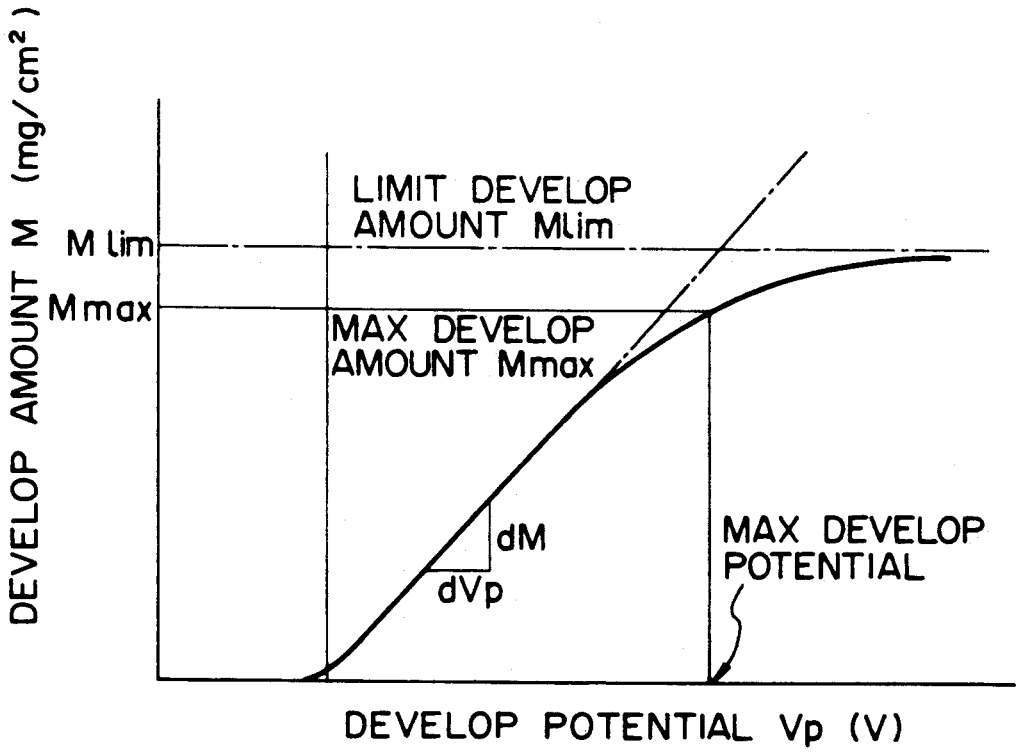
FIG. 1 is a graph representative of a developing characteristic.
Figure 2:
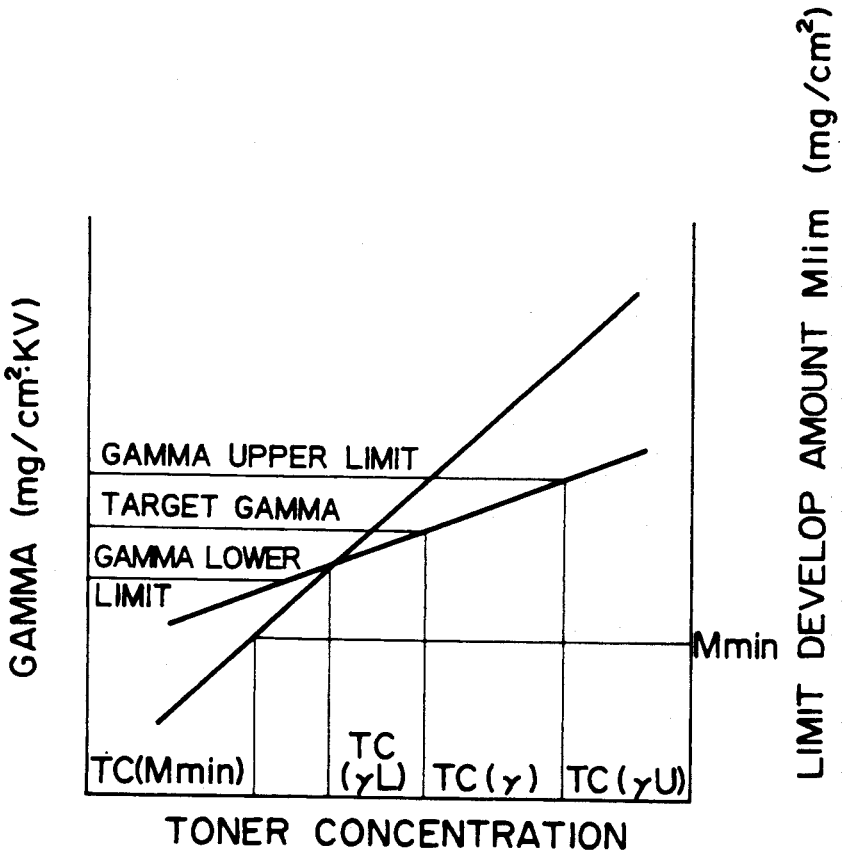
FIG. 2 is a graph indicating the dependency of a developing characteristic on toner concentration.

To better understand the present invention, a developing system of the type using a two-component developer will be described generically. FIG. 1 shows a developing characteristic particular to this type of developing system. As shown, the developing characteristic has two different ranges, i.e., a linear range in which the developing amount M linearly increases with the increase in the developing potential Vp, and a saturation range in which the former gradually approaches the limit developing amount Mlim away from the line in the linear range with the increase in the latter. The gradient dM/dVp of the linear range is generally referred to as development gamma. As shown in FIG. 2, both the gamma and the limit developing amount Mlim are dependent on the concentration of toner in a developer, i.e., the former increases with the increase in the latter. Regarding the reproducibility of a halftone image, a prerequisite with this type of developing system is that limit developing amount Mlim be sufficiently greater than the developing amount Mmax corresponding to the maximum developing potential of the system. Specifically, the system has to be used in the linear range in order to enhance the reproducibility of tones. The lower limit of toner concentration, therefore, should be limited by some means or method.

Figure 3:
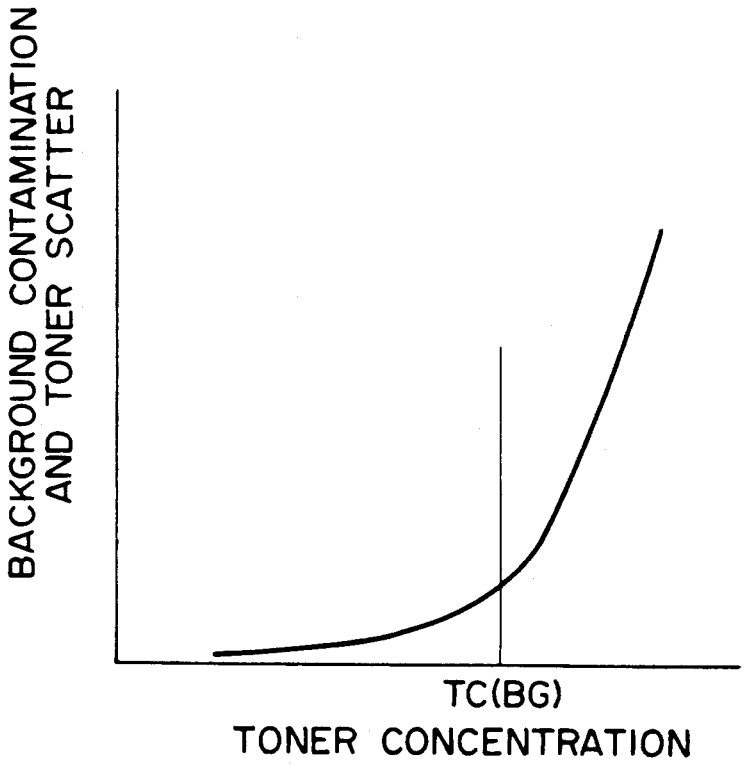
FIG. 3 is a graph indicating the dependency of background contamination and other occurrences on toner concentration.

On the other hand, as FIG. 3 indicates, toner concentrations higher than a certain value TC (BG) cause toner particles to deposit on and contaminate the background and to scatter around off the developer to the outside of a developing unit, for the following reasons. Carrier and toner particles constituting at two-component developer rub against each other and are charged thereby. Hence, when the amount of toner is excessive relative to the limited effective charging area of the carrier, the toner cannot be sufficiently charged and are, therefore, separated from the carrier to cause the above-mentioned undesirable occurrence. It follows that the toner concentration has to be provided with an upper limit by some means or methods.

Figure 4:
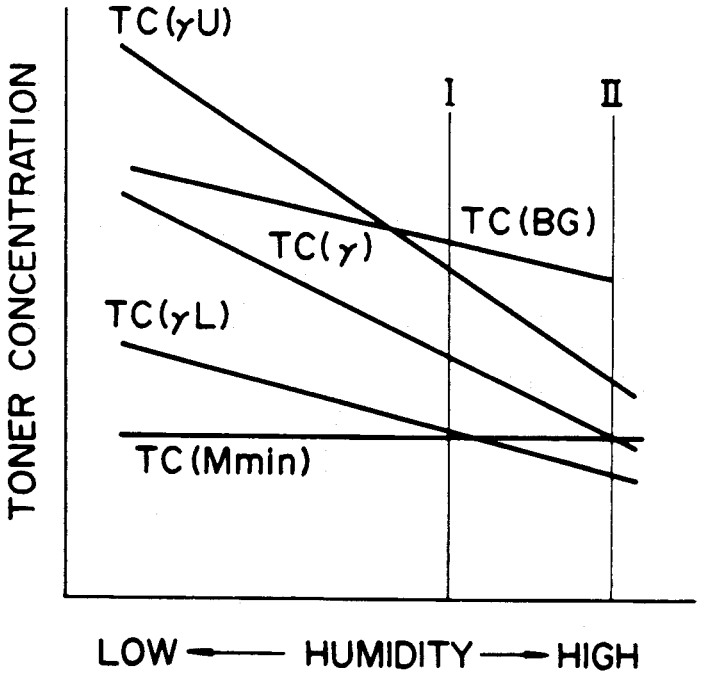
FIG. 4 is a graph showing the variation of toner concentration due to the variation of an ambient condition.
Figure 5:
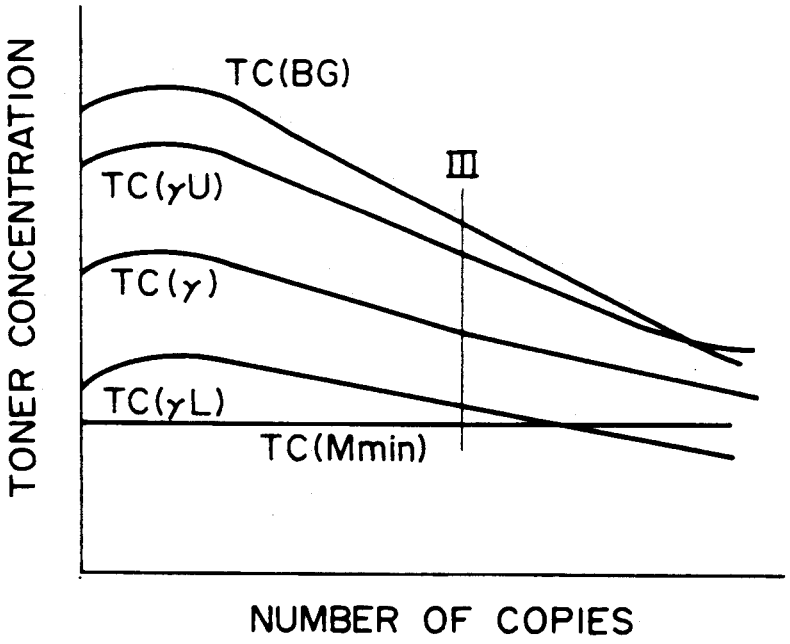
FIG. 5 is a graph representative of the variation of toner concentration due to aging.

Generally, the developing characteristic of and the background contamination by a two-component type developer stated above changes every moment depending on ambient conditions in which the machine is operated or left non-operated, the duration of non-operation, the number of times that copies are produced, etc. Presumably, this is ascribable to the amount of adsorption of water molecules by the surface of toner and carrier which varies with temperature and humidity, the amount of deposition of impurities on the carrier surface which varies with duration of operation, and the variation of the charging and discharging amounts of toner (and carrier). FIGS. 4 and 5 show how the toner concentration which determines the characteristic points of developing characteristic varies with the ambient conditions and due to aging, by using specific values determined by experiments. FIG. 4 shows the toner concentration in relation to the variation in humidity which is one typical ambient condition. The characteristic shown in FIG. 4 was measured with the number of copies produced being fixed to a particular number represented by III in FIG. 5. FIG. shows a characteristic measured by taking account of aging, i.e., with the number copies produced being increased. The curves of FIG. 5 were attained with the ambient conditions being maintained constant, i.e., with the humidity being fixed at I shown in FIG. 4. Actually, these variations are combined with each other as well as with other variations such as one ascribable to the operation modes including the area ratio of a document, how many copies should be produced with a single copy, how many copies should be produced by one operation, and how long the machine has been left non-operated as counted from the last copying operation.

In FIGS. 2, 4 and 5, a curve TC (Mmin) indicates toner concentrations which prevents the developing amount Mmax associated with the maximum potential of the developing system from becoming less than the minimum necessary developing amount of the system. A curve TC ($\gamma$) indicates toner concentrations which allow the gamma to coincide with the target value. A curve TC ($\gamma$U) is representative of the upper limit of gamma required with the system; higher toner concentrations would thicken characters and/or result in short resolutions. Further, a curve TC($\gamma$L) is the lower limit of gamma which is required with the system; lower toner concentration would lower the image density beyond an allowable range. It is to be noted that the curve TC($\gamma$L) was estimated by using the linear portion of the developing characteristic and, in practice, the image density will be further lowered due to the previously mentioned saturation.

In any case, in the developing system using a two-component type developer, the toner concentration has a critical effect on the developing characteristic and, therefore, has to be adequately controlled. While the previously stated control methods A and B have been proposed in the past, they are not fully satisfactory for the reasons discussed earlier.

Figure 6:
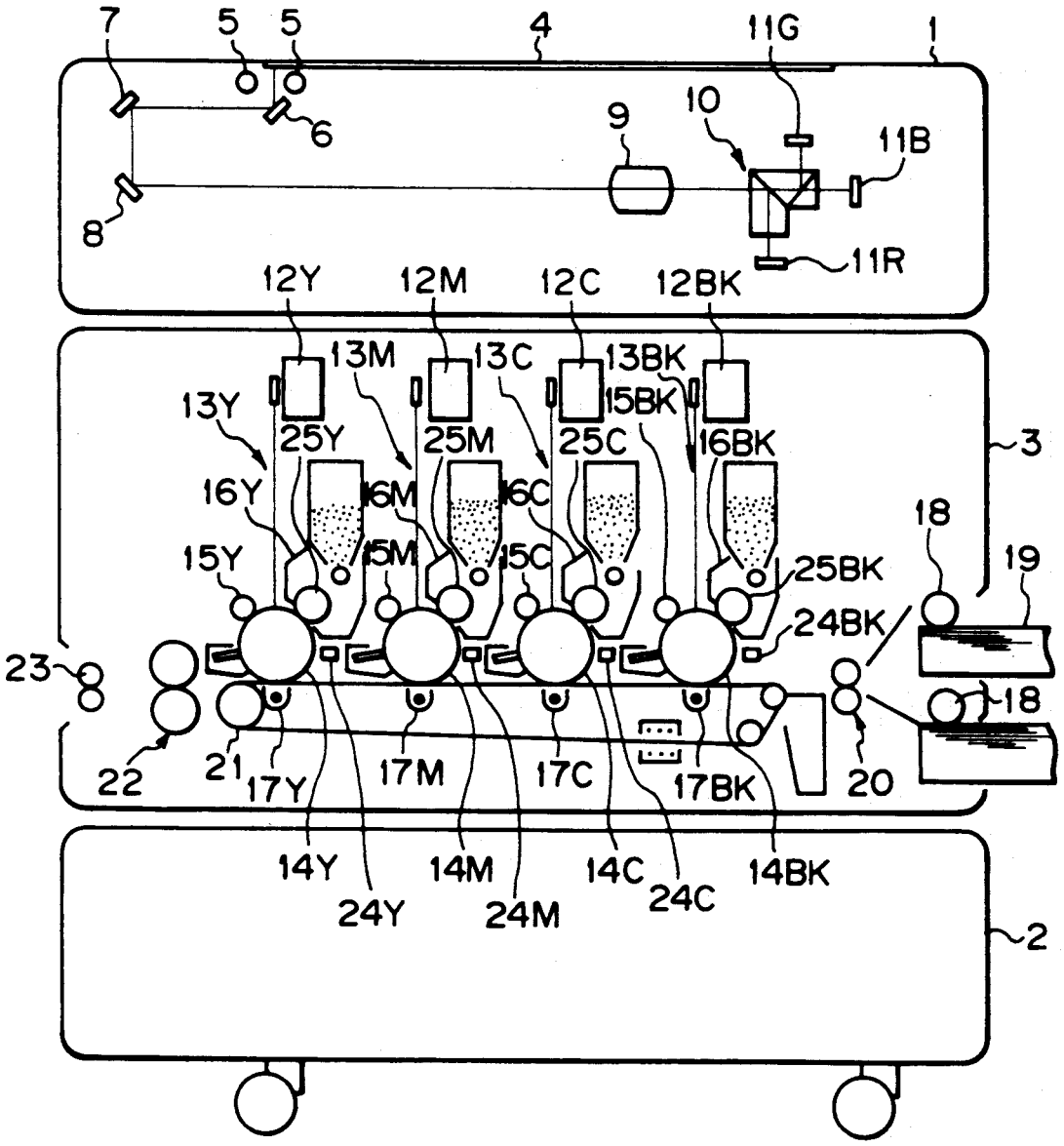
FIG. 6 is a section showing a color copier to which a preferred embodiment of the color image forming equipment in accordance with the present invention is applicable.

A reference will be made to FIGS. 6 through 9 for describing the method which we proposed in previously mentioned U.S. patent application Ser. No. 07/545,508. FIG. 6 schematically shows digital color image forming equipment (color copier) to which the proposed method is applicable. As shown, the equipment is generally made up of a scanner section 1 for scanning a document, an image processing section 2 for electrically processing a digital image signal outputted by the scanning section 1, and a printer section 3 for printing out an image on the basis of color-by-color image recording information outputted by the image processing section 2. The scanner section 1 has a fluorescent lamp or similar lamp 5 for illuminating a document on a glass platen 4. A reflection from the document is incident to a focusing lens 9 via mirrors 6, 7 and 8. The lens 9 focuses the incident light onto a dichroic prism 10 with the result that the light is spectrally separated into three components each having a different wavelength, i.e., red (R), green (G), and blue (B) components. These color components are incident to individual light-sensitive devices such as CCD (Charge Coupled Device) arrays 11R, 11G and 11B and thereby transformed into digital signals. The image processing section 2 effects necessary processing with the outputs of the CCD arrays 11R, 11G and 11B to convert them into recording information of different colors, e.g., black (BK), yellow (Y), magenta (M) and cyan (C) signals.

While the equipment of FIG. 6 is shown as forming a color image in four colors BK, Y, M and C, it may form a color image in only three colors by having on of four recording devices, which will be described, omitted.

The individual color signals from the image processing section 2 are fed to associated laser writing units 12BK, 12C, 12M and 12R which are incorporated in the printer section 3. In the specific arrangement shown in FIG. 6, four recording devices 13BK, 13C, 13M and 13Y are arranged side by side in the printer section 3. Since all the recording devices 13BK to 13Y have identical structural parts and elements, the following description will concentration on the device 13C adapted for cyan C by way of example. The structural parts and elements of the other recording devices are identical with those of the device 13C and are designated by the same reference numerals with suffixes BK, M and Y.

The recording device 13C has a photoconductive element 14C in the form of a drum, for example, in addition to the laser writing unit 12C. Sequentially arranged around the drum 14C are a main charger, 15C, an exposing position where a laser beam issuing from the laser writing unit 12C will scan the drum 14C, a developing unit 16C, a transfer charger 17C, and so forth. While the main charger 15C uniformly charges the surface of the drum 14C, the laser writing device 12Cd scans the charged drum surface with a laser beam with the result that a latent image representing a cyan component is electrostatically formed on the drum 14C. Then, the developing unit 16C develops the latent image to produce a toner image. A paper feeding section 19 is implemented as two paper cassettes, for example. A paper sheet fed from either one of the paper cassettes by an associated feed roller 18 is driven to a register roller pair 20 and, at a predetermined timing, driven away from the register roller pair 20 to a transfer belt 21. The transfer belt 21 transports the paper sheet sequentially to the drums 14BK, 14C, 14M and 14Y each carrying a toner image of a particular color thereon. The transfer chargers 17BK through 17Y associated with the drums 13BK–14Y, respectively, transfer such toner images sequentially to the paper sheet. The paper sheet carrying the resultant toner image thereon is driven out of the equipment by a discharge roller pair 23 after having the image fixed thereon. In this instance, the paper sheet is electrostatically retained by the transfer belt 21 and, therefore, transported with accuracy. Reflection type photosensors or P sensors 24BK, 24C, 24M and 24Y are associated with the drums 14BK, 14C, 14M and 14Y, respectively, and each optically senses the amount of toner deposited on a toner image pattern which will be described. The P sensors 24BK–24Y are operable in the same manner as one another with their associated drums 14BK–14Y and, in the following description, they will be represented by the reference numeral 24 without suffix.

In the proposed method described above, sensor pattern forming means forms toner density patterns to be sensed by the P sensor 24 and is also implemented with the charger 15, laser writing unit 12, and developing unit 16. Specifically, the toner image patterns each has a particular image density. Such toner image patterns may be formed by any of some different implementations, as follows. For example, an arrangement may be made such that the quantity of exposing light issuing from the laser writing unit 12 is changed in two steps to form latent image patterns having two different potentials, while the potential of a developing sleeve 25, i.e., a developing bias is maintained constant. Conversely, the quantity of exposing light from the laser writing unit 12 may be maintained constant to form latent images of the same potential (latent image patterns of the same kind), in which case the developing bias of the sleeve 25 will be changed in two steps. Another alternative implementation is to form two latent image patterns having different potentials and developing them by different developing biases. The toner image patterns are not limited to solid images each having a substantial area and may even be dot or line patterns representing desired tones.

Figure 7:
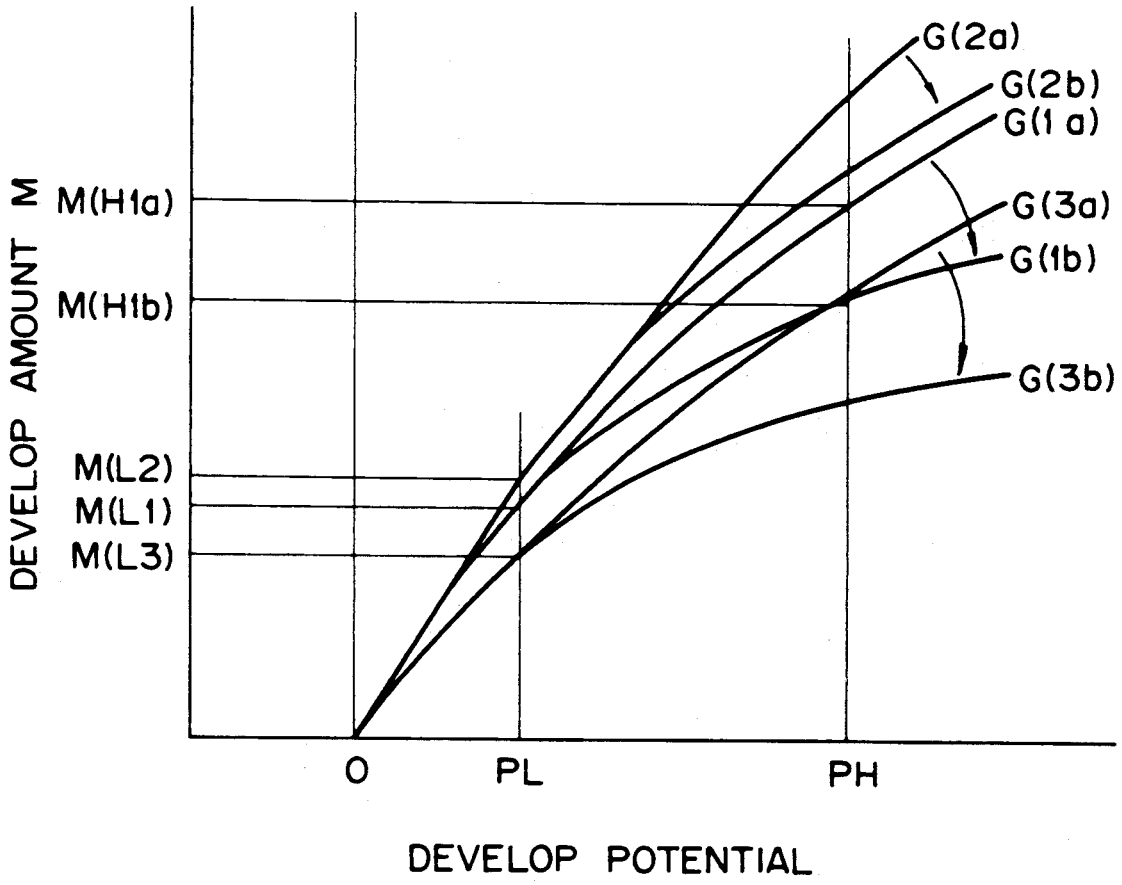
FIG. 7 is a graph showing a developing characteristic in terms of developing amounts and developing potentials of two different patterns.

Assume that the developing potentials of the two latent image patterns ascribable to the differences between the surface potentials and the developing bias are PL and PH (PL<PH), and that, among tones 9–7, tones 3 and 7 are assigned to PL and PH, respectively. Further, assume that when the dynamic range I of a latent image (difference between the maximum and minimum values of the surface potential of a drum formed by a latent image) has a certain value, a developing characteristic G(1*a*) shown in FIG. 7 is the optimal characteristic. Then, the developing amounts of the patterns whose developing potentials are PL and PH are M(L1) and M(H1a), respectively. When the toner concentration is increased in the above environment, i.e., at the same time, the developing characteristic is shifted from G(1*a*) to G(2*a*), FIG. 7, causing the developing amounts associated with the developing potentials PH and PH to change to M(L2) and M(H2a), respectively. Conversely, a decrease in the toner concentration shifts developing characteristic from G(1*a*) to G(3*a*), FIG. 7, while the developing amounts associated with PL and PH change to M(L3) and M(H3a), respectively. With the developing characteristic of FIG. 7, therefore, it is possible to control the toner concentration such that the actual developing characteristic approaches the target characteristic G(1*a*), if the P sensor 24 senses either one of the developing amounts associated with PL and PH. This is the same as the system using a P sensor. In the proposed method, the above control is effected by using the pattern image having the lower developing potential PL.

The above description has concentrated on the same environment and the same time point. How the developing characteristic changes with the environment will be described hereinafter. Assume that the ambient humidity is increased while the developing amount of the pattern associated with the developing potential PL is sensed by the P sensor 24 and controlled to a target value. As shown in FIG. 4, as the ambient humidity increases, toner concentration for maintaining the adequate gamma decreases with the result that, as FIG. 2 indicates, the saturation developing amount increases. Hence, the developing characteristic varies as represented by a curve G(1*b*), FIG. 7, whereby the developing amount M(1*b*) associated with the developing potential PH is made smaller than the amount M(H1*a*) associated with usual humidity. It follows that the dynamic range I is adjustable by detecting the difference between M(1*b*) and M(H1*a*).

Figure 8:
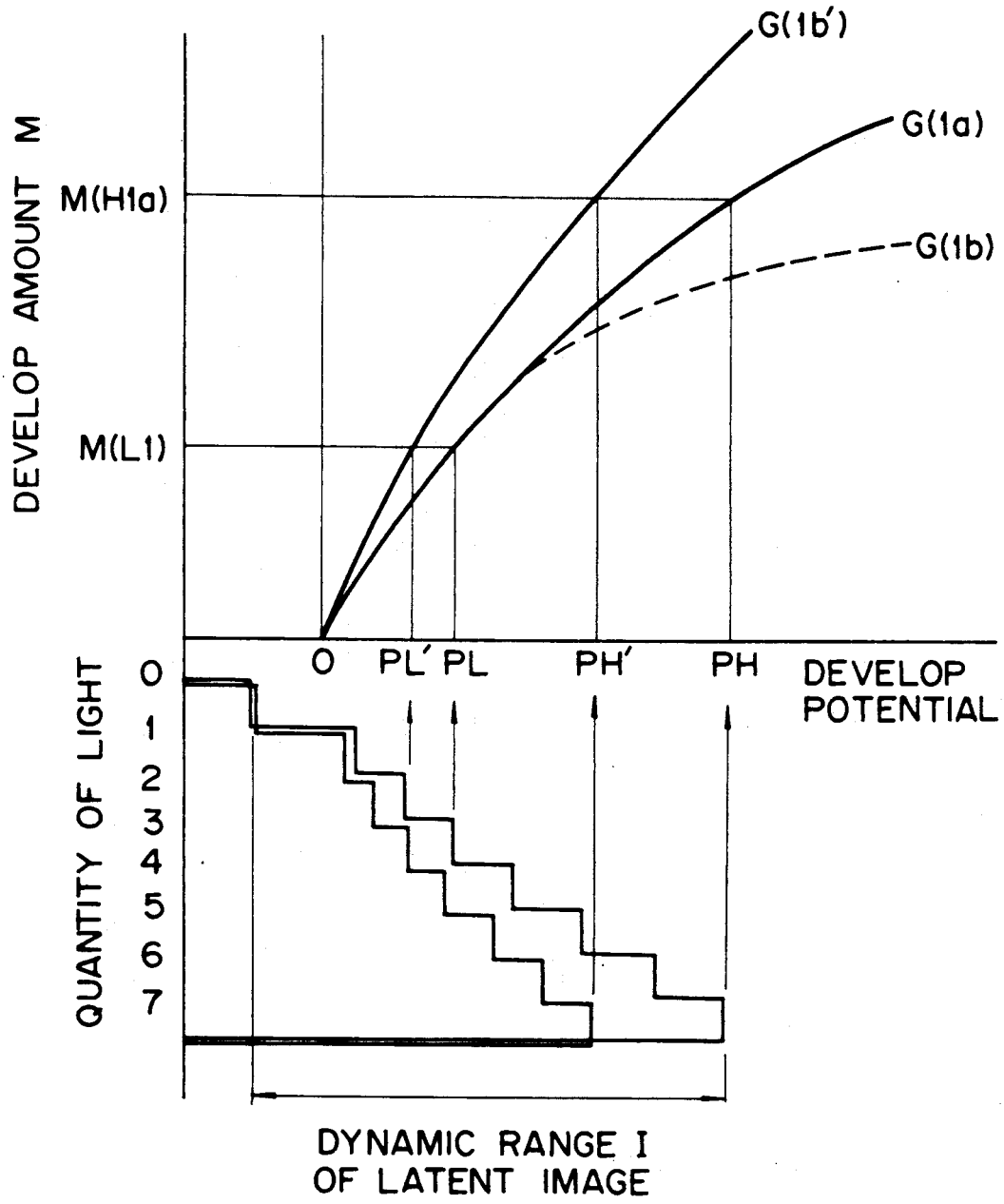
FIG. 8 is a graph indicating how the developing characteristic changes in association with the adjustment of the dynamic range of a latent image.

To facilitate an understanding of the adjustment of the dynamic range I, let it be assumed that the maximum quantity of light of a light image and the developing potential PH are equal to each other, although not necessarily equal in practice. Referring again to FIG. 1, on the change of the developing characteristic from G(1*a*) to G(1*b*), the tone reproducibility is degraded and the maximum amount of toner deposition (=M(1*b*)) is reduced. In the light of this, the dynamic range I of the latent image is reduced with the ratio of the developing potentials PL and PH being held constant. Then, since the toner concentration is so controlled as to maintain M(L1) constant, it sequentially increases with the decrease in developing potential PL→PL' with the result that the curve representative of the developing characteristic rises away from G(1*b*). Such an adjustment is continued until the developing amount M(H1*b*) coincides with the target value M(H1*a*), i.e., until the developing characteristic G(1*b*') holds, on the basis of the output of the P sensor 24 associated with the developing potentials PH-PH'. This is successful in maintaining the developing amount associated with the image signal constant. Therefore, the color copier shown in FIG. 6 is capable of recording halftone in a desired manner. It will be seen that the proposed method is characterized in that when the target developing characteristic G(1*a*), FIG. 8, is changed to G(1*b*) due to the highly humid environment, control is effected to shift the characteristic G(1*a*) to the characteristic G(1*b*').

When the humidity is low, a procedure opposite to the above-stated procedure will be executed. The control described above in relation to humidity is also true with aging. While the proposed method changes the dynamic range by changing the quantity of light issuing from the exposing means 12, the quantity may be replaced with the charging potential of the main charger 15 or may be changed along with the latter.

Figure 9:
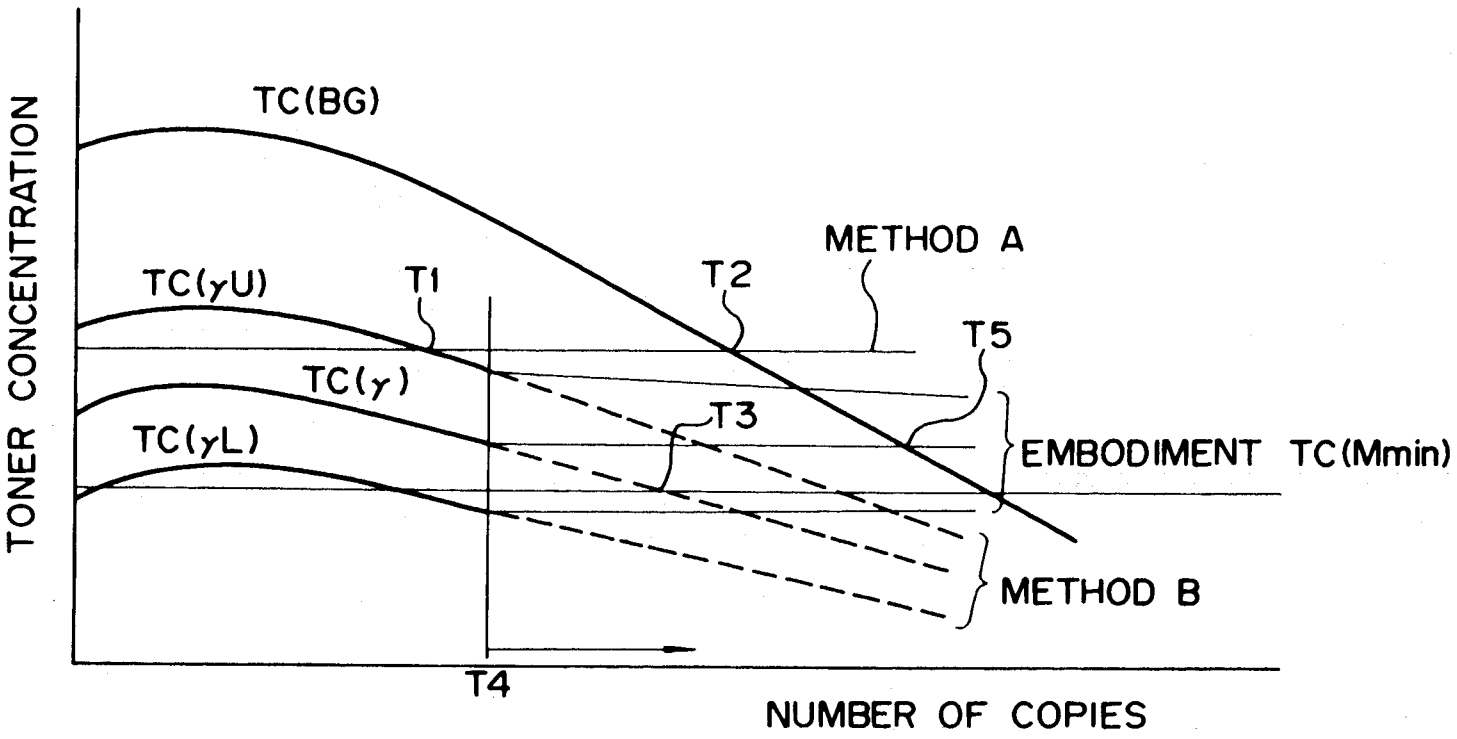
FIG. 9 is a graph comparing an illustrative embodiment of the present invention and the prior art with respect to variation in toner concentration.

FIG. 9 compares the proposed method and the prior art methods A and B with respect to the variation of toner concentration. While the curves of FIG. 9, like those of FIG. 5, pertain to againg as defined by the number of copies produced, they are representative of changes in a high humidity environment II, FIG. 4, as distinguished from the usual humidity environment of FIG. 5. As shown, the method A which controls the toner concentration to a predetermined value fails to achieve high image quality and wastes the developer unless the developer is replaced at a time $T_1$ at which time the toner concentration coincides with the concentration TC ($\gamma$U). In this connection, some black-and-white printers available today allow the developer to be used until a time $T_2$ at which time the toner concentration coincides with the toner density TC (BG). The method B which controls the developing ability to a predetermined one determines that the life of the developer has expired at a time $T_3$ at which time the toner concentration TC ($\gamma$) coincides with TC (Mmin), requiring the devloper to be replaced, as indicated by dotted lines in the figure. In contrast, with the proposed method which controls the toner concentration TC ($\gamma$) constant while preventing it from decreasing beyond the initial value, it is possible to use the developer until the toner concentration TC (BG) reaches the target concentration TC ($\gamma$) at a time $T_5$. Concerning the proposed method, FIG. 9 indicates a case wherein the dynamic range is sequentially reduced from the time $T_4$. The curves of FIG. 9 show that the proposed method is capable of insuring high image quality over a long period of time and extends the life of the developer, compared to the prior art methods.

Figure 10:
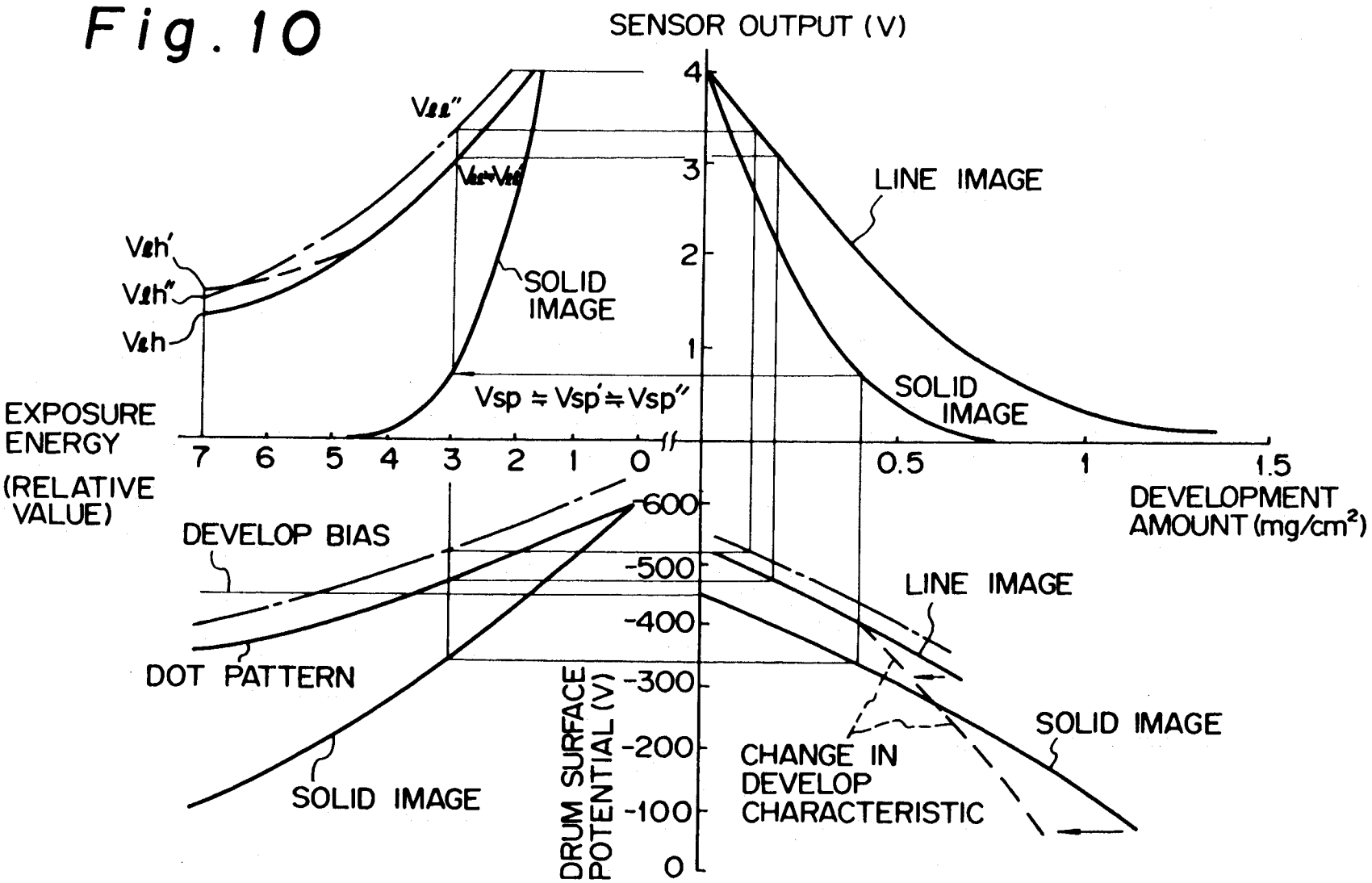
FIG. 10 is a graph indicating the response characteristic of a photosensor.
Figure 11:
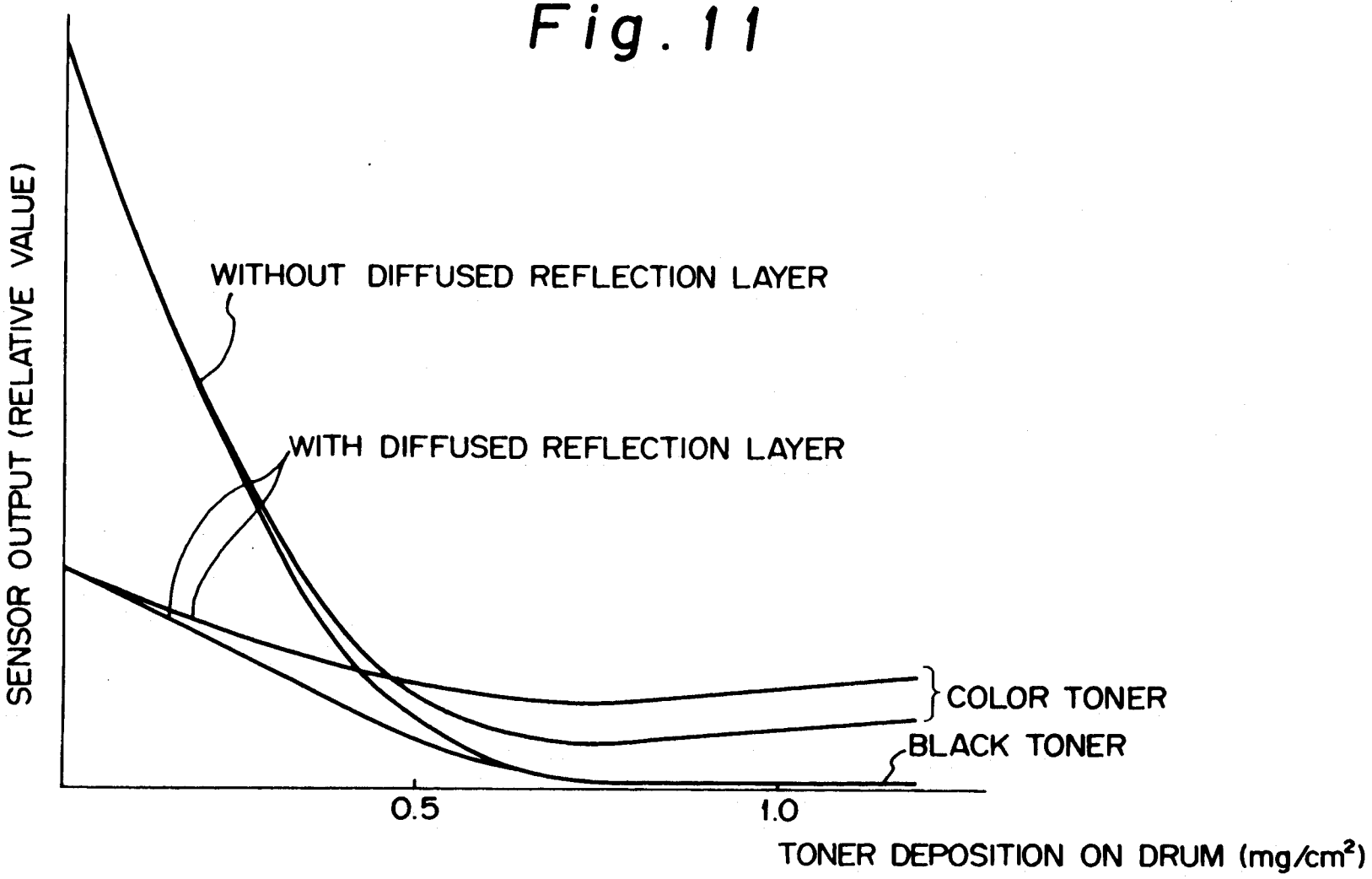
FIG. 11 is a graph indicating the change in the characteristic of a photosensor ascribable to the amount of toner deposition.
Figure 12:
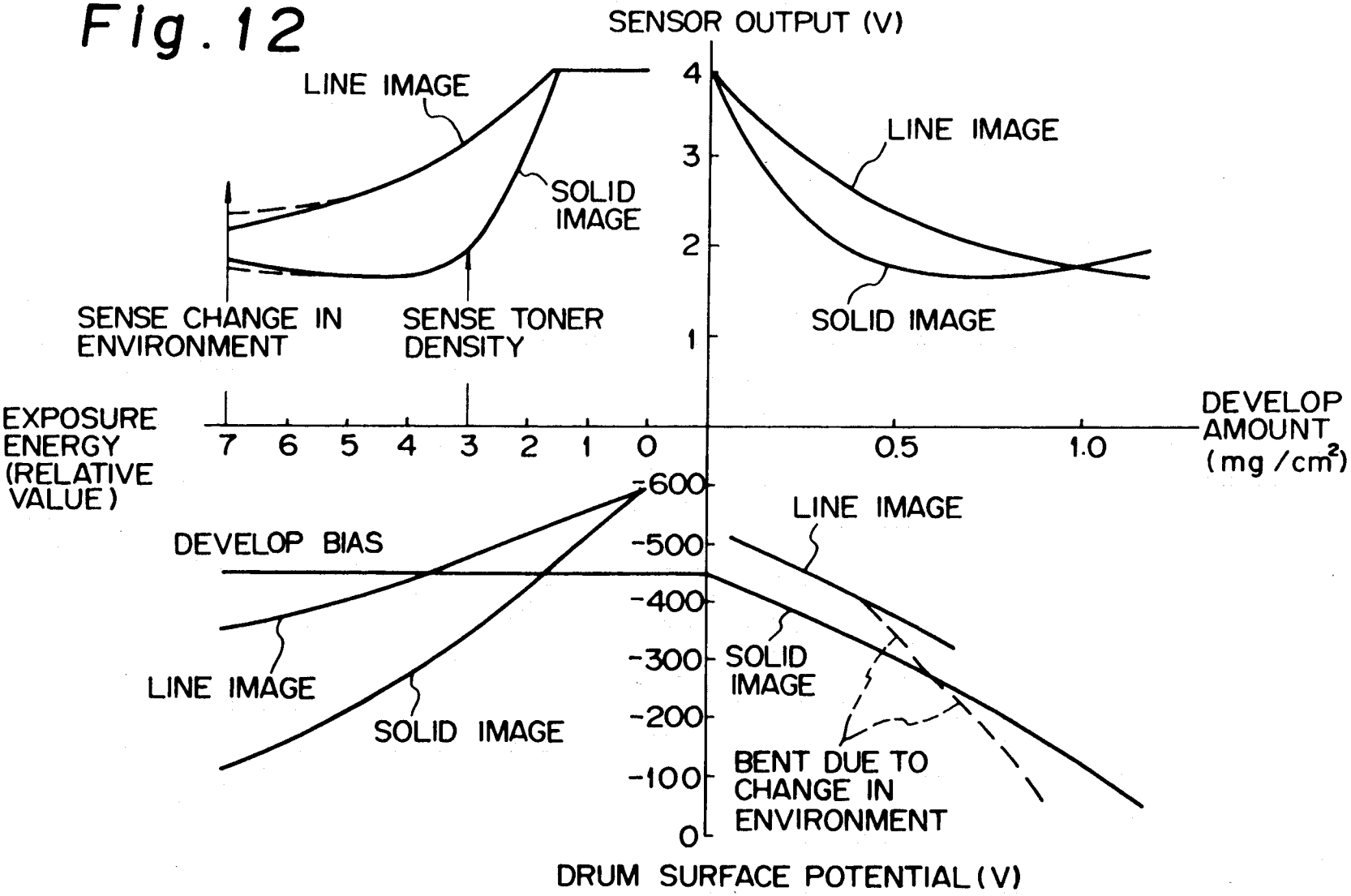
FIG. 12 is a graph showing the response characteristic of a photosensor in relation to a color toner.

Referring to FIGS. 10 through 12, the method we proposed in Japanese Patent Application No. 238107/1989 will be described. In the figures, the same parts and elements as those shown in FIGS. 1 through 9 are designated by the same reference numerals, and redundant description will be avoided for simplicity. This proposed method constitutes an improvement over the previously described proposed method of ours. Specifically, by using the fact that the response characteristic of the P sensor 24 differs from a solid toner pattern having a substantial area to a line toner image, the proposed method which will be described grasps the change in developing characteristic with accuracy.

The background art of the proposed method will be described first. The developing characteristic is hard to grasp accuratey when the maximum developing amount Mmax should be such that one or more toner layers cover the surface of a photoconductive element. This is because, as shown in FIG. 11, the sensing characteristic of the P sensor 24 is substantially saturated when the toner is deposited in one layer on a photoconductive element (0.5 mg/cm$^2$), and the sensitivity is almost zero when it comes to two or more toner layers. More specifically, since the P sensor 24 is responsive to the quantity of light (ratio) by which a reflection from the surface of a photoconductive element is intercepted by the toner deposition, the sensing range is just up to the instant when the toner convers the surface of a photoconductive element in one layer.

The condition wherein the toner cannot sufficiently absorb the light from the P sensor 24 such as when the toner is a color toner is another problem. The absorption ratio of a color toner is less than 30% for the light of 900 and several nm which is the detectable range of the P sensor 24. Specifically, since a diffused reflection from a color toner increases with the amount of toner deposition, there exists a range wherein, as shown in FIG. 11, the quantity of sensed light (reflection) increases with the increase in the amount of toner deposition (slightly rising to the right).

Moreover, the condition wherein a photoconductive element has a layer which diffuses or absorbs more than one half of the light from the P sensor 24 is another problem. Actually, some photoconductive elements for use with laser printers are provided with a layer for diffused reflection in order to prevent a laser beam from being reflected multiple times between the surface of the photoconductive element and the substrate to form an interference pattern. Then, the quantity of reflection from the photoconductive element is reduced, compared to the quantity of diffused reflection from the toner. As a result, the signal-to-noise (S/N) radio is lowered to aggravate erroneous detection, as represented by "WITH DIFFUSED REFLECTION LAYER" in FIG. 11.

In light of the above, our proposed method which will be described uses at least two different kinds of toner image patterns including a solid image having a substantial area and an image other than a solid image, i.e., a line image. Here, assume three different kinds of toner image patterns, i.e., a solid image pattern having a medium density (P sensor output Vsp), a line image pattern having a medium density (P sensor output Vl), and a line image pattern having the maximum density (P sensor output Vlh). Assuming a given constant Vspo, the toner is supplied when the value Vsp measured with the solid image pattern is smaller than the constant Vspo or not supplied when the former is greater than the latter.

The control over the image forming conditions particular to the proposed method is as follows. Table 1 shown below lists charge potentials Vo, developing bias voltages Vb, potentials Vp of a toner image pattern portion, and toner control constants Vspo which are stored in a memory together with pointers P.

TABLE 1

| POINTER P | V0 | Vb | V1 | V0-Vb |
|---|---|---|---|---|
| 0 | 363 | 278 | 188 | 75 |
| 1 | 369 | 290 | 196 | 78 |
| 2 | 384 | 306 | 208 | 78 |
| 3 | 400 | 318 | 216 | 82 |
| 4 | 416 | 329 | 224 | 86 |
| 5 | 431 | 345 | 235 | 86 |
| 6 | 447 | 357 | 243 | 90 |
| 7 | 463 | 369 | 256 | 94 |
| 8 | 478 | 380 | 263 | 98 |
| 9 | 494 | 396 | 276 | 98 |
| 10 | 510 | 408 | 282 | 102 |
| 11 | 525 | 420 | 294 | 106 |
| 12 | 641 | 431 | 302 | 110 |
| 13 | 557 | 447 | 314 | 110 |
| 14 | 573 | 459 | 322 | 114 |
| 15 | 588 | 471 | 329 | 118 |
| 16 | 604 | 486 | 341 | 118 |
| 17 | 620 | 498 | 349 | 122 |
| 18 | 635 | 610 | 361 | 125 |
| 19 | 651 | 522 | 369 | 129 |
| 20 | 667 | 537 | 380 | 129 |

TABLE 1-continued

| POINTER P | V0 | Vb | V1 | V0-Vb |
|---|---|---|---|---|
| 21 | 682 | 649 | 388 | 133 |
| 22 | 698 | 561 | 396 | 137 |
| 23 | 714 | 576 | 408 | 137 |
| 24 | 729 | 588 | 416 | 141 |
| 25 | 745 | 600 | 427 | 146 |
| 26 | 761 | 612 | 435 | 149 |
| 27 | 776 | 627 | 447 | 149 |
| 28 | 792 | 639 | 455 | 153 |
| 29 | 808 | 651 | 463 | 157 |
| 30 | 824 | 667 | 475 | 157 |
| 31 | 839 | 678 | 482 | 161 |

The control is effected by using Table 1 and the target value Vdo of Vll-Vlh, the lower $P_1$ of pointer, the upper limit $P_2$ of pointer, a given constant Po which is greater than $P_1$ and smaller than $P_2$, the increment or decrement Di (=0, 1, 2) of pointer ($D_0 \leqq D_1 \leqq D_2$), a constant Vdn for determining the unvariable range of pointer, and the running mean Vda of the differences between measured values Vll and Vlh.

FIG. 10); in the worst case, the sensitivity is reversed (the sensor output increases with the increase in the amount of toner deposition), as shown in FIG. 12 corresponding to FIG. 10.

On the other hand, an advantage particular to a line image pattern is that even when the amount of toner deposition is great, Vlh is not equal to Vlh' and, therefore, the sensitivity of the P sensor 24 is insured. However, the problem with a line image pattern is that the absolute value of the sensor output is not fully reliable since the developing amount changes (Vll≠Vll" or Vlh≠Vlh) with the background potential (=difference between background potential and developing bias) and the quality of the latent image of the line image pattern in addition to the developing potential. The quality of the latent image includes the focus and flare in the case of analog, the spread of a laser spot and the ringing of rise and fall of ON and OFF in the case of digital laser writing, or the amount by which the light is intercepted, the open/close speed, the restriction of a beam and the flare light in the case of a liquid crystal shutter scheme.

TABLE 2

| POINTER P OF CONDITION TABLE STORED IN MEMORY | POINTER P OF CONDITION TABLE (CONDITION FOR NEXT IMAGE FORMING) | | | |
|---|---|---|---|---|
| DECREASE←DYNAMIC RANGE→INCREASE | | | | |
| $P = P_2$ | DECREASE BY D2 | DECREASE BY D0 | NO CHANGE | NO CHANGE |
| $P_0 < P < P_1$ | DECREASE BY D2 | DECREASE BY D0 | NO CHANGE | INCREASE BY D1 |
| $P = P_0$ | DECREASE BY D0 | NO CHANGE | NO CHANGE | INCREASE BY D1 |
| $P_1 > P > P_0$ | DECREASE BY D1 | NO CHANGE | INCREASE BY D0 | INCREASE BY D2 |
| $P = P_1$ | NO CHANGE | NO CHANGE | INCREASE BY D0 | INCREASE BY D2 |
| ESTIMATED CURRENT DYNAMIC RANGE VS. PROPER ONE BASED ON Vda | BROAD | SOMEWHAT BROAD OR ADEQUATE | SOMEWHAT NARROW OR ADEQUATE | NARROW |
| RUNNING MEAN Vda OF (Vll − Vlh) (MEASURED) | Vda < Vdo − Vdn | Vdo − Vdn ≦ Vda < Vdo | Vdo ≦ Vda < Vdo − Vdn | Vdo + Vdn ≦ Vda |

It is to be noted that while the toner supply control os effected every time a copying cycle is completed, the control over the image forming conditions is effected when a copy button is pressed again after a sequence of copying operations.

FIG. 10 is indicative of the response characteristic of the P sensor 24 particular to the proposed method with respect to a relation between the developing amount and the P sensor output, a relation between the exposing energy and the P sensor output, a relation between the exposing energy and the surface potential of a photoconductive element, and a relation between the developing amount and the surface potential. The characteristic of FIG. 10 was determined with a black toner. Regarding a solid image pattern, the developing amount is dependent only on the developing ability of a developer (=amount of charge Q/M of toner) and the developing potential (=difference between pattern potential and developing bias). Hence, with a solid image pattern, it is possible to readily grasp the developing ability of a developer only if the developing potential is maintained constant. More specifically, the P sensor output associated with the solid image pattern having a medium density is Vsp≈Vsp". However, the problem is that the P sensor sensitivity decreases to zero when the amount of toner deposition is great (black toner; Vsp≈Vsp', In light of the above, out proposed method uses the advantages particular to the sensor response characteristics derived from a solid image and a line image in grasping the change in developing characteristic with accuracy, as shown in Table 2. The toner density and dynamic and dynamic range are variably controlled on the basis of the change in developing characteristic. Specifically, when the relative value of exposing energy is "7" which causes a great amount of toner to deposit, changes is ambient conditions are sensed on the basis of the sensed output Vlh associated with the line image pattern having the maximum density. When the relative value of exposing energy is "3", the toner density is sensed on the basis of the solid image pattern and line image pattern each having a medium density. This kind of control will be referred to as DIF control hereinafter.

We have also proposed in Japanese Patent Laid-Open Publication No. 113093/1990 an implementation which, in the event of correcting the dynamic range with respect to the charge potential, quantity of exposing light and developing bias for forming an image in matching relation to the density level sensed by the photosensor, variably controls the developing bias to maintain the photosensor output on the photoconductive element constant.

In the above-described DIF control, when the control is effected with respect to consecutive tones "0" to "7", a great number of data are averaged to enhance the reliability of sensor outputs. Therefore, the DIF control consumes a substantial period of time in collecting data and sometimes fails to adjust the dynamic range by immediately following a sharp change in surrounding conditions. For example, when a copier is moved from a relatively hot and humid room to a relatively cool and dry room, the toner is apt to deposit on the sleeve to reduce the effect achievable with a developing bias. In light of this, the developing bias is changed in such a manner as to maintain the output of the photosensor constant. Specifically, the developing bias is shifted by (Vb=target Vb at current stage+Vbs) such that the toner deposition on the sleeve tends to decrease, resulting in the increase in toner concentration. No correction is effected against such a change until all the data from the photosensor have been inputted, resulting in slow adjustment.

Figure 13:
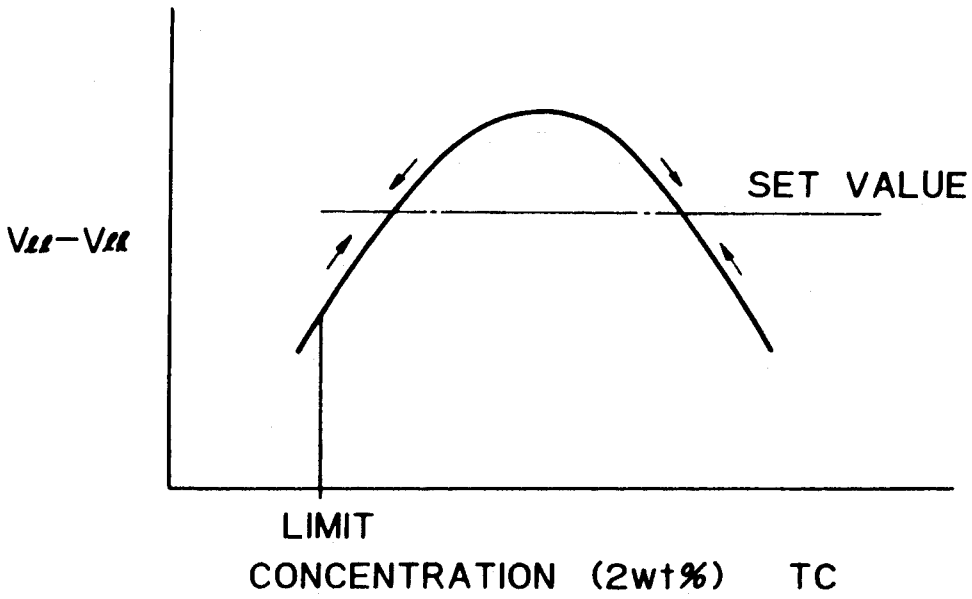
FIG. 13 is a graph indicative of a relation between a relation between a sensed potential and a developing density with respect to two different kinds of toner image patterns.

FIG. 13 shows a relation between the toner concentration (TC) and Vdo (Vll−target Vlh) pertaining to the DIF control. As shown, target Vdo values have an identicare distribution at opposite sides with respect to the peak of the curve. Therefore, it is likely with the DIF control that the toner concentration uncontrollably increases since the control associated with the target value is different at opposite sides with respect to the peak and since the correcting direction is entirely different from the actual one.

When any one of the dynamic range control schemes selects a dynamic range or changes over the developing bias, it sets the subject of control at all of the several predetermined tones. This brings about a drawback that when the toner concentration on the photoconductive element, for example, is greatly different from the target concentration, the period of time necessary for the actual concentral to reach the target concentration is apt to increase since the step changes or the concentration is apt to sharply change since the shift of developing bias increases. Moreover, for the dynamic range control, the density detection necessary for a particular dynamic range to be selected is performed on condition that the quantity of exposing light as measured on the photoconductive element be maintained constant. Actually, however, a toner image pattern is sometimes formed even when an adequate quantity of light is not attainable due to, for example, the contamination of optics. Then, the selected dynamic range would erroneous and prevent an adequate toner concentration from being set up on the photoconductive element.

Figure 14:
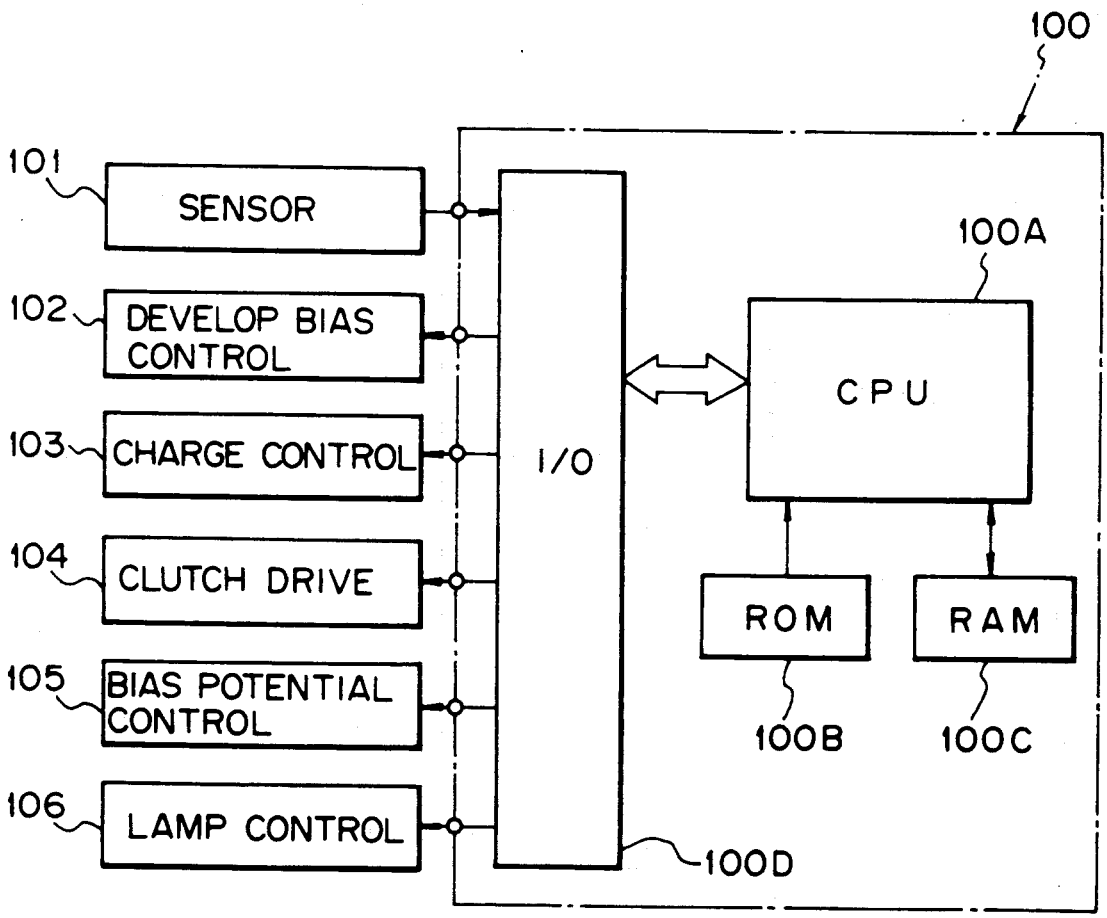
FIG. 14 is a block diagram schematically showing a control section included in the embodiment of the present invention.

Referring to FIGS. 14 through 25, color image forming equipment embodying the present invention will be described. As shown in FIG. 14, a control section included in the embodiment is shown. As shown, the control section, generally 100, has a microcomputer (CPU) 100A to which a ROM 100B and a RAM 100C are connected. The ROM 100B stores basic programs for executing arithmetic and control processing as well as basic data for such processing. An external arrangement is connected to the RAM 100C via an I/O interface 100D. Specifically, a photosensor 101 is connected to the input side of the I/O interface 100D and representative of the sensors 24BK, 24C, 24M and 24Y, FIG. 6. Comprising a light emitting element and a light-sensitive element, the photosensor 101 is responsive to the amount of toner deposition of a pattern formed on a photoconductive element, i.e., a toner concentration TC. Connected to the output side of the I/O interface 100D are a developing bias control unit 102, a charge control unit 103, a clutch driver 104 associated with a toner supply section, a bias potential control unit 105 also associated with the toner supply section, and a lamp control unit 106 for exposure. The developing bias unit 102 of the external arrangement plays the role of a driver for setting the bias potential of a toner on a developing sleeve. The charge control unit 103 serves as a driver for setting the charge potential of the background of a photoconductive element. The clutch driver 104 drives a clutch associated with a paddle when the density of the developed pattern on a photoconductive element (i.e. density Vsp of solid image pattern) is related with a given constant Vspo as Vsp>Vspo. The bias potential control unit 105 sets up a potential when a bias is to be applied to the toner. Further, the lamp control unit 108 controls the quantity of light to issue from a lamp.

Figure 15:
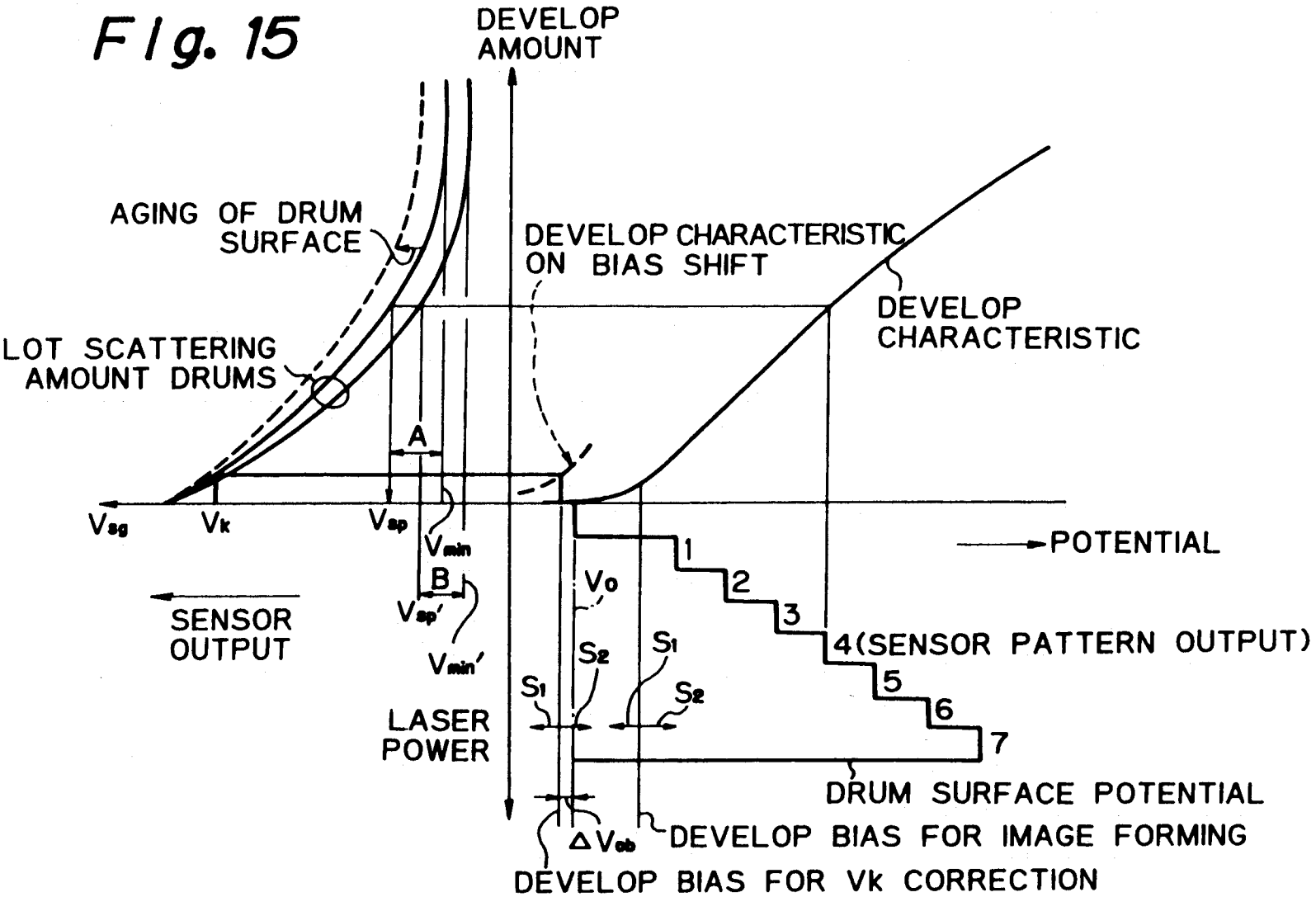
FIG. 15 is a graph useful for understanding Vk control to be executed by a control section shown in FIG. 14.

In the illustrative embodiment, the CPU 100A performs correction in the case wherein the developing bias is variable and the effective bias voltage is to be maintained constant relative to the charge potential of a photoconductive element. Such control for maintaining the effective bias constant is executed after or before an image forming operation, as follows. As shown in FIG. 15, a developing bias Vb with a small potential difference ΔVob such as one-fifth or less of an image forming potential is applied to a developing sleeve in the opposite direction to the relation to the background potential Vo of a photoconductive element particular to the ordinary image forming operation (Vb indicated by a solid line is greater than negative potential Vo). In this condition, a toner is caused to deposit on the photoconductive element. The developing bias Vb is sequentially shifted in the direction indicated by arrows S1 and S2 until the output Vk (potential when an extremely low potential is sensed) of the photosensor for sensing the density of the toner image becomes constant. The illustrative embodiment considers the shift Vbs as a difference between the effective developing bias and the output developing bias and adds it to a developing bias at the time of actual image forming operation. More specifically, the embodiment considers the developing bias Vb as a sum of the developing bias Vb (target value) and the value Vbs for cancelling the difference between the bias Vb (target value) and the effective developing bias. A shift of the developing bias with respect to the background potential Vo of the photoconductive drum is produced by:

$$Vb = Vb\ (\text{target value}) + Vbs \quad (1)$$

$$Vb\ (\text{target value}) = Vo + Vbk \quad (2)$$

$$Vb = Vo + Vbk + Vbs \quad (3)$$

where Vbk is equal to the image forming potential Vk (e.g. 24 V).

Assuming that the photosensor output under the above condition is Vk, shifting Vb such that the photosensor output Vk reaches a target value Vko thereof is successful in determining a deviation of the effective developing bias, i.e., an optimal shift.

In this embodiment, the running mean of eight Vk's is produced and compared with Vko. When the difference between the resulted mean Vk and Vko is less than 0.1 V (or 0.2 V in the case of black development), the Vk control is not effected in order to reduce the influence of the irregularity of charge:

$$|Vk - Vko| < 0.1\ V \quad (4)$$

More specifically, assume that the target potential of the control image pattern portion with a toner concentration TC is Vtc, that the target potential of bias shift is Vko, and that the n-th potential sensed by the photosensor is Vsp (n) regarding the TC control pattern portion and Vk (n) regarding the bias shift. Then, so long as the toner concentration control is normal, the following relation holds with most of n's:

$$|Vsp - Vtc| < 0.2\ V \quad (5)$$

(or 0.4 V in the case of black development)

In this case, the running mean of the bias shift detection potentials Vk (n) is produced as a shift Vk, as follows:

$$Vk = (\tfrac{1}{8}) \sum_{n=2}^{8} Vk(n) \quad (6)$$

On the other hand, when the toner concentration control is not normal, the relation (4) does not hold, i.e., the following relation holds with some or all of n's:

$$|Vsp(n) - Vtc| < 0.2\ V \quad (7)$$

(or 0.4 V in the case of black development)

In such a condition, for all of n's with which the relation (7) holds, the target value Vko of Vk is substituted for Vk (n):

$$Vk(n) = Vko \quad (8)$$

Then, the running mean of the shifts Vk is produced with Vk (n) by use of the equation (6).

Also, in the illustrative embodiment, the Vk image forming potential Vbk is conditioned such that an electric field acts in the forward direction, i.e., a direction for developing an ordinary latent image so as to reduce the effect of a reversely charged toner (negatively charged toner does not develop a latent image under the forward electric field). In addition, Vbk is set at a higher level than the amount of deposition of an ordinary small amount of non-charged toner to thereby eliminate the influence of the background contamination of the photoconductive drum. This is successful in preventing the bias shift and, therefore, the toner concentration from uncontrollably increasing when the background is contaminated too much to be cleaned by the increase in developing bias (due to reversely charged toner), and in reducing the sensing errors of the photosensor.

Assume that the toner concentration has deviated from a predetermined one (Vsp deviated from Ttc, FIG. 15) due to the inaccurate detection of a toner end condition which will occur when the toner supply is incomplete or when the equipment runs out of toner. Then, the developing ability and, therefore, Vk is lowered. In such a case, the embodiment reduces the correction of Vk (i.e. shift of bias Vb) or, if the deviation is noticeable, does not execute the correction at all. Specifically, when the toner concentration control undergoes a transition from a normal state to an abnormal state, the embodiment sequentially changes the amount of Vk correction in association with the degree of abnormality. When the actual toner concentration is entirely different from the predetermined value due to, for example, the incomplete detection of a toner end condition, the amount of correction is reduced to zero. However, when simply the ripple is great such as when the equipment is operated in a hot and humid environment with a fatigued developer, the degree of correction is reduced although the correction is effected. In this kind of control, the toner is fed to the photoconductive drum by a developing bias Vb slightly different from the background potential Vo of the drum and opposite in direction to the relation particular to an image forming operation. The developing bias Vb is shifted such that the output Vk of the photosensor associated with the resulted toner image remains constant. As a result, the developing bias Vb is maintained constant relative to the background potential Vo of the drum to in turn eliminate the deviation of effective developing bias, whereby the image quality is enhanced. For such a control procedure, a reference may be made to our Japanese Patent Application No. 113093/1989.

When the ambient conditions are changed, especially when temperature and humidity are lowered, the amount of charge deposited on the toner and, therefore, the ability of the carrier to retain the toner is lowered with the result that the toner accumulates on the developing sleeve. The charge of the toner so deposited on the sleeve causes the effective developing bias to change. Such a change in effective bias can be detected if the previously stated value Vbs is detected. As stated earlier, since this deviation of effective developing bias is ascribable to the changes in ambient conditions, the latter can be detected, although not directly, if the effective bias is detected.

The DIF control described above becomes unstable as the temperature and humidity lower, i.e., as the toner concentration increases. Specifically, since the DIF control relies on the output of the photosensor representative of the amount of toner concentration prevents the output of the photosensor from accurately representing the amount of toner deposition. More specifically, the sensitivity of the photosensor is not reliable in a high concentration area, compared to a solid image pattern. Then, the Vbs control which prevents fluctuations in low temperature and low humidity environments is applicable to high concentration areas.

The CPU 100A changes over the variable control over the dynamic range depending on whether the value Vbs, i.e., the correction amount of the sensed bias shift potential is higher or lower than a predetermined reference value. Here, the developing bias Vb, charge potential Vo and quantity of light Vl are set by use of the pointers shown in Table 1. Specifically, when Vbs is higher than a reference voltage of −100 V which is represented by pointer #23 in Table 1, the dynamic range for forming an image is corrected by the DIF control shown in Table 3 below. Conversely, when Vbs is lower than the above-mentioned reference value, the developing bias is corrected by the Vbs control shown in Table 4 below.

TABLE 3

| | BELOW DIFO − α | DIFO − α DIFO | DIF DIFO + α | ABOVE DIF |
|---|---|---|---|---|
| 0 | 0 | 0 | 1 | 4 |
| 1 | −4 | −1 | 1 | 4 |
| . | | | | |
| . | | | | |

TABLE 3-continued

| | BELOW DIFO − α | DIFO − α DIFO | DIF DIFO + α | ABOVE DIF |
|---|---|---|---|---|
| 22 | | | | |
| 23 | −4 | −1 | 0 | 0 |

Note: α is 0.32 V in the case of black development or 0.16 V in the case of color development.

TABLE 4

| Vbs | −104 (23) | −112 (24) | −120 (25) | −128 (26) | −136 (27) | −140 (28) | −152 (29) | −160 (30) | −168 (31) |
|---|---|---|---|---|---|---|---|---|---|
| 23 | 0 | +4 | +16 | +32 | +64 | +128 | +128 | +128 | +128 |
| 24 | −4 | 0 | +4 | +16 | +32 | +64 | +128 | +128 | +128 |
| 25 | −16 | −4 | 0 | +4 | +16 | +32 | +64 | +128 | +128 |
| 26 | −32 | −16 | −4 | 0 | −4 | +16 | +32 | +64 | +128 |
| 27 | −64 | −32 | −16 | −4 | 0 | +4 | +16 | +32 | +64 |
| 28 | −128 | −64 | −32 | −16 | −4 | 0 | +4 | +16 | +32 |
| 29 | −128 | −128 | −64 | −32 | −16 | −4 | 0 | +4 | +16 |
| 30 | −128 | −128 | −128 | −64 | −32 | −16 | −4 | 0 | +4 |
| 31 | −128 | −128 | −128 | −128 | −64 | −32 | −16 | −4 | 0 |

The operation of the embodiment having the above construction will be described with reference to FIGS. 16 through 25.

Figure 16:
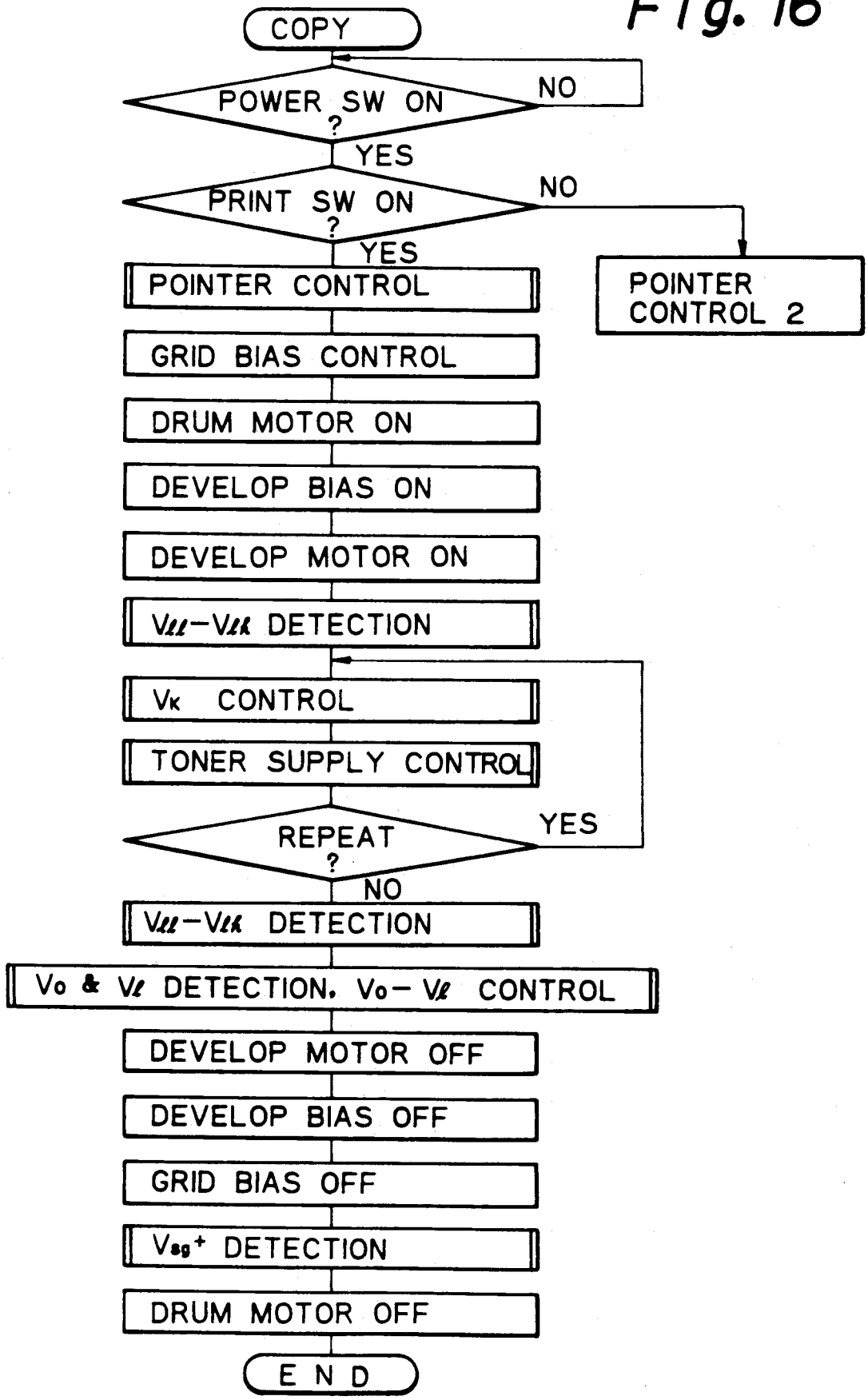
FIGS. 16, 17, 18, 19, 20, 21, 22, 23, 24, 24A, 24B, and 25 are flowcharts demonstrating a specific operation of the control section depicted in FIG. 14.
Figure 17:
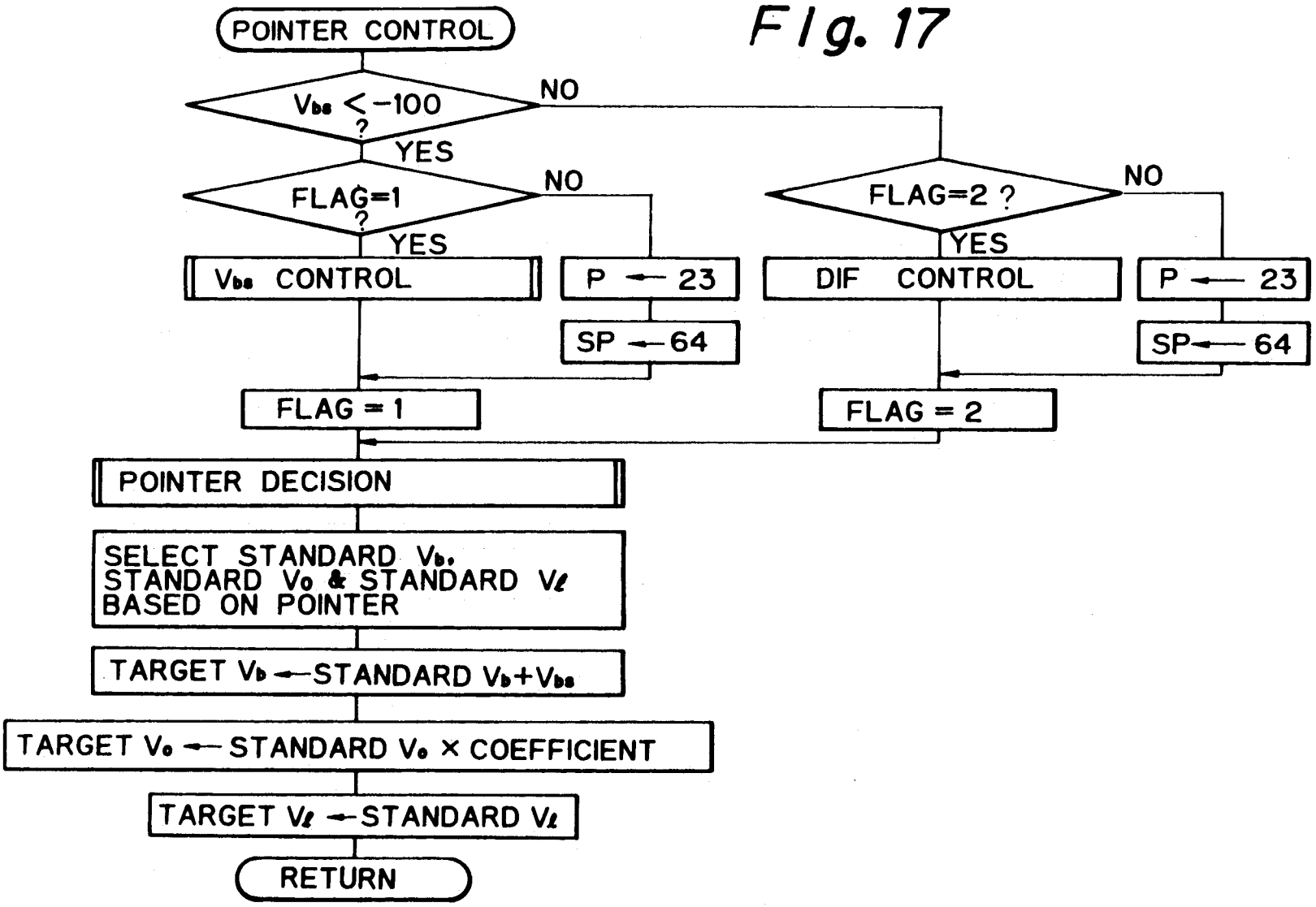
Figure 18:
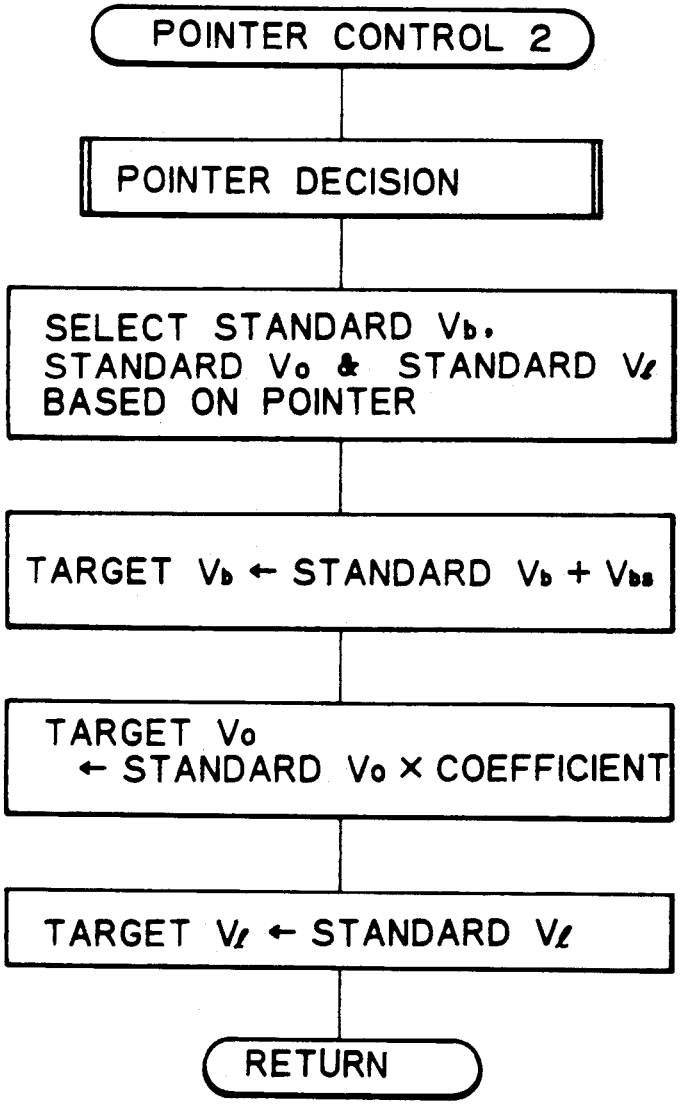

FIG. 16 is representative of sequence control meant for the operations of the entire copier. As shown, the procedure begins with a step of determining whether or not a power switch has been turned on and, if it has been turned on, whether or not a copy start switch or print start switch has been turned on. Depending on the answer of this decision, the CPU 100A sets the background potential of the photoconductive drum by either one of pointer controls 1 and 2, as follows. As shown in FIG. 17, in the pointer control 1, the CPU 100A determines whether or not the shift Vbs of the developing bias is smaller than a predetermined value and, if the answer is positive, determines whether or no a flag representative of such a state has been set. If the flag of interest has been set, the CPU 100A executes Vbs control. If the flag has not been set, the CPU 100A fixes the pointer at pointer #23 and fixes the subpointer at subpointer #64. As shown in FIG. 18, in the pointer control 2, pointers are determined as in the pointer control 1, and then the shift of developing bias, charge potential and targe quantity of light are set on the basis of the pointers.

Figure 19:
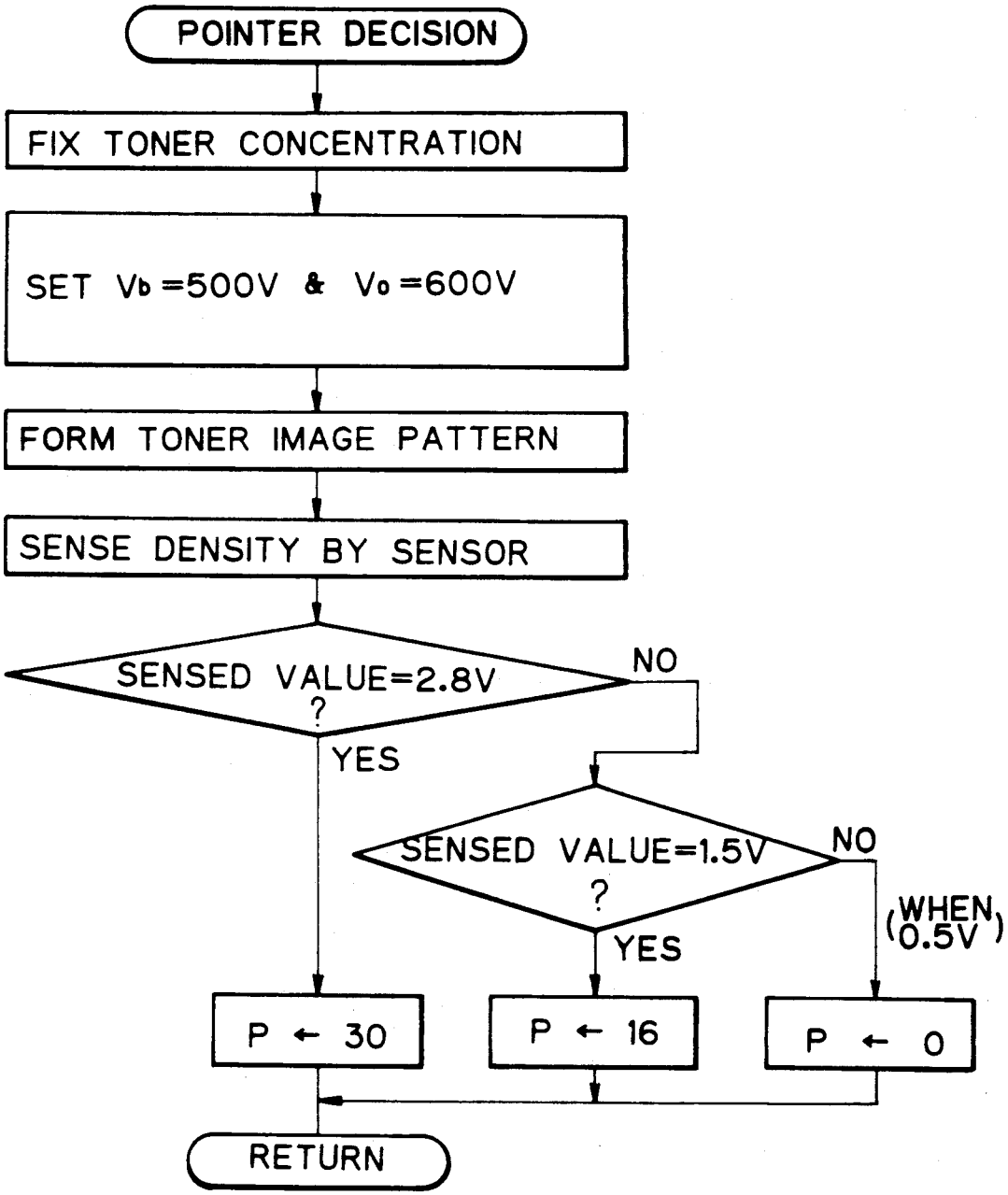

In FIG. 17 wherein the pointer and subpointers are fixed, whether or not the current pointer setting is adequate is determined on the basis of the amount of toner deposition due to temperature and humidity, as in FIG. 18. Specifically, as shown in FIG. 19, the CPU 100A causes a toner image pattern to be formed on the photoconductive element while maintaining the existing toner density and by fixing the developing bias Bbs and charge potential Vo at, for example, 500 V and 600 V, respectively. Then, the CPU 100A determines whether or not pointer correction is necessary in response to the resulted concentration output and, if it is necessary, selects a particular pointer matching the concentration, as shown in Table 5 below.

TABLE 5

| TEMP. HUMID | 10° C. 15% | 23° C. 65% | 30° C. 90% |
|---|---|---|---|

TABLE 5-continued

| DEVELOP CONDITION | | | |
|---|---|---|---|
| (Vb) 500 V (Vo) 600 V | 2.8 V | 1.5 V | 0.5 V |
| POINTER | 30 | 16 | 0 |

The decision and correction of pointer stated above is to correct the amount of toner deposition on the photoconductive element which decreases in low temperature and low humidity environments and increases in the opposite environments, as shown in FIG. 4.

Figure 20:
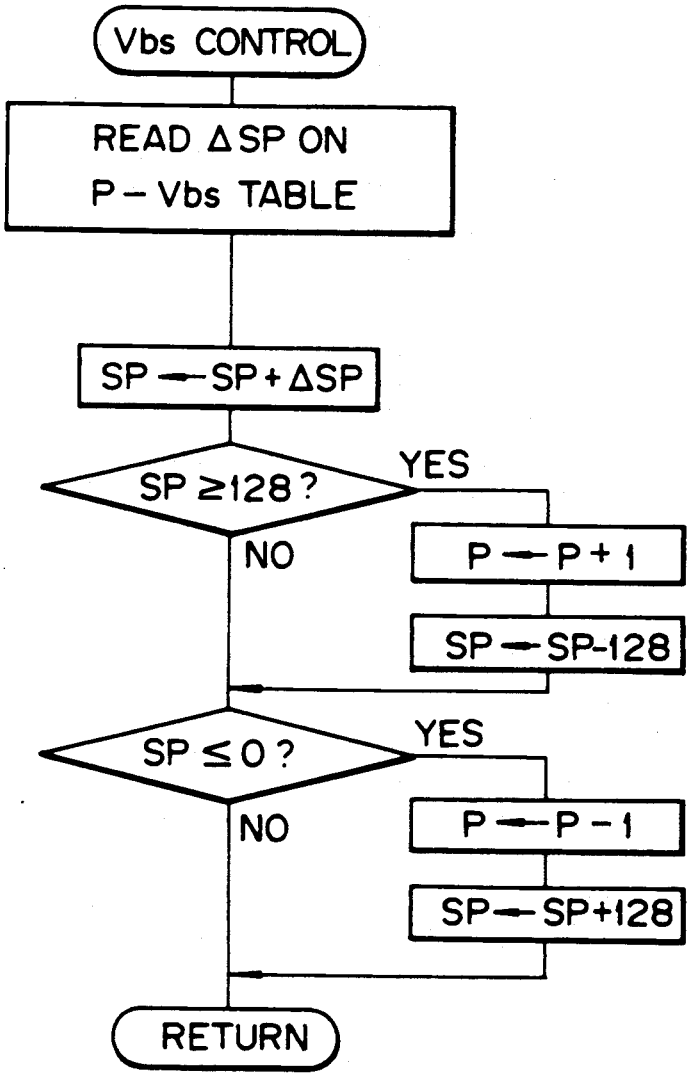

As shown in FIG. 20, in the Vbs control, the CPU 100A Selects ΔSP in a pointer (P)-Vbs table and determines whether or not the subpointer is greater than or equal to "128". Based on the result of decision, the CPU 100A updates the pointer and subpointer. Then, the CPU 100A determines whether or not the subpointer is smaller than or equal to zero and, if the answer is positive, selects a pointer one step lower than the existing pointer while updating the subpointer accordingly. Assume that the developing bias is shifted in the event when the first copy is to be executed. Then, in the Vbs control, the embodiment sets the shift in the range of, for example, 20 V by neglecting the range of, for example, 8 V which is usually the limit of shift, thereby reducing the time necessary for the toner to reach a predetermined concentration.

Figure 21:
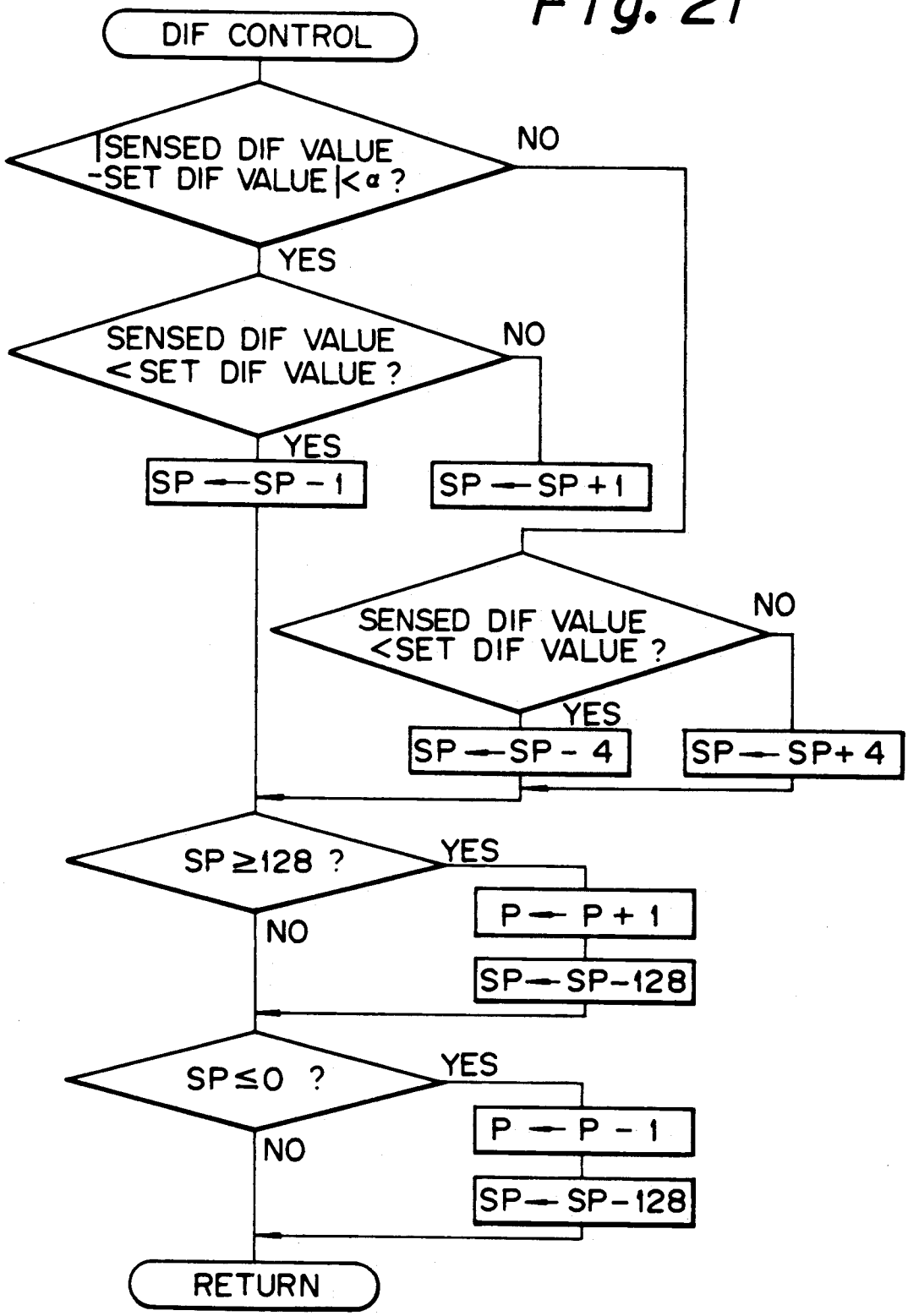

On the other hand, when the shift Vbs of the developing bias is not smaller than the predetermined value, the CPU 100A determines whether or not a flag representative of such a state has been set. If the answer of this decision is positive, the CPU 100A executes the DIF control; if otherwise, the CPU 100A fixes the pointer and subpointer as in the above-stated Vbs control. As shown in FIG. 21, in the DIF control, the CPU 100A produces a difference α between a detected DIF value resulted from the previously stated Vll−Vlh and a set DIF value. Then, the CPU 100A determines whether or not the difference α is smaller than 0.24 V in the case of black development or smaller than 0.12 V in the case of color development. If the answer is positive, the CPU 100A determines which of the detected value and the set value is greater than the other and, based on the resulted relation, carries down or carries up the subpointer. This is also true when the answer of the decision on the above-mentioned difference is negative. Then, the CPU 100A corrects the pointer and subpointer by determining the updated subpointer is smaller or greater than "128" on the basis of a relation between the pointer and Vbs shown in Table 6 below.

TABLE 6

| | Vis | | | | | | | | | | |
|---|---|---|---|---|---|---|---|---|---|---|---|
| POINTER | 80 | 72 | 64 | 56 | 48 | 40 | 32 | 24 | 16 | 8 | 0 |

TABLE 6-continued

| | | | | | | | | | | | |
|---|---|---|---|---|---|---|---|---|---|---|---|
| 0 | 0 | +4 | +16 | +32 | +64 | +128 | +128 | +128 | +128 | +128 | +128 |
| 1 | −4 | 0 | +4 | +16 | +32 | +64 | +128 | +128 | +128 | +128 | +128 |
| 2 | −16 | −4 | 0 | +4 | +16 | +32 | +64 | +128 | +128 | +128 | +128 |
| 3 | −32 | −16 | −4 | 0 | +4 | +16 | +32 | +64 | +128 | +128 | +128 |
| 4 | −64 | −32 | −16 | −4 | 0 | +4 | +16 | +32 | +64 | +128 | +128 |
| 5 | −128 | −64 | −32 | −16 | −4 | 0 | +4 | +16 | +32 | +64 | +128 |
| 6 | −128 | −128 | −64 | −32 | −16 | −4 | 0 | +4 | +16 | +32 | +64 |
| 7 | −128 | −128 | −128 | −64 | −32 | −16 | −4 | 0 | +4 | +16 | +32 |
| 8 | −128 | −128 | −128 | −128 | −64 | −32 | −16 | −4 | 0 | +4 | +16 |
| 9 | −128 | −128 | −128 | −128 | −128 | −64 | −32 | −16 | −4 | 0 | +4 |
| 10 | −128 | −128 | −128 | −128 | −128 | −128 | −64 | −32 | −16 | −4 | 0 |
| 11 | −128 | −128 | −128 | −128 | −128 | −128 | −128 | −64 | −32 | −16 | −4 |
| 12 | −128 | −128 | −128 | −128 | −128 | −128 | −128 | −128 | −64 | −32 | −16 |
| 13 | −128 | −128 | −128 | −128 | −128 | −128 | −128 | −128 | −128 | −64 | −32 |
| 14 | −128 | −128 | −128 | −128 | −128 | −128 | −128 | −128 | −128 | −128 | −64 |
| 15 | −128 | −128 | −128 | −128 | −128 | −128 | −128 | −128 | −128 | −128 | −128 |
| 16 | −128 | −128 | −128 | −128 | −128 | −128 | −128 | −128 | −128 | −128 | −128 |
| 17 | −128 | −128 | −128 | −128 | −128 | −128 | −128 | −128 | −128 | −128 | −128 |
| 18 | −128 | −128 | −128 | −128 | −128 | −128 | −128 | −128 | −128 | −128 | −128 |
| 19 | −128 | −128 | −128 | −128 | −128 | −128 | −128 | −128 | −128 | −128 | −128 |
| 20 | −128 | −128 | −128 | −128 | −128 | −128 | −128 | −128 | −128 | −128 | −128 |
| 21 | −128 | −128 | −128 | −128 | −128 | −128 | −128 | −128 | −128 | −128 | −128 |
| 22 | −128 | −128 | −128 | −128 | −128 | −128 | −128 | −128 | −128 | −128 | −128 |
| 23 | −128 | −128 | −128 | −128 | −128 | −128 | −128 | −128 | −128 | −128 | −128 |
| 24 | −128 | −128 | −128 | −128 | −128 | −128 | −128 | −128 | −128 | −128 | −128 |
| 25 | −128 | −128 | −128 | −128 | −128 | −128 | −128 | −128 | −128 | −128 | −128 |
| 26 | −128 | −128 | −128 | −128 | −128 | −128 | −128 | −128 | −128 | −128 | −128 |
| 27 | −128 | −128 | −128 | −128 | −128 | −128 | −128 | −128 | −128 | −128 | −128 |
| 28 | −128 | −128 | −128 | −128 | −128 | −128 | −128 | −128 | −128 | −128 | −128 |
| 29 | −128 | −128 | −128 | −128 | −128 | −128 | −128 | −128 | −128 | −128 | −128 |
| 30 | −128 | −128 | −128 | −128 | −128 | −128 | −128 | −128 | −128 | −128 | −128 |
| 31 | −128 | −128 | −128 | −128 | −128 | −128 | −128 | −128 | −128 | −128 | −128 |

| | Vis | | | | | | | | | | |
|---|---|---|---|---|---|---|---|---|---|---|---|
| POINTER | −8 | −16 | −24 | −32 | −40 | −48 | −56 | −64 | −72 | −80 | −88 |
| 0 | +128 | +128 | +128 | +128 | +128 | +128 | +128 | +128 | +128 | +128 | +128 |
| 1 | +128 | +128 | +128 | +128 | +128 | +128 | +128 | +128 | +128 | +128 | +128 |
| 2 | +128 | +128 | +128 | +128 | +128 | +128 | +128 | +128 | +128 | +128 | +128 |
| 3 | +128 | +128 | +128 | +128 | +128 | +128 | +128 | +128 | +128 | +128 | +128 |
| 4 | +128 | +128 | +128 | +128 | +128 | +128 | +128 | +128 | +128 | +128 | +128 |
| 5 | +128 | +128 | +128 | +128 | +128 | +128 | +128 | +128 | +128 | +128 | +128 |
| 6 | +128 | +128 | +128 | +128 | +128 | +128 | +128 | +128 | +128 | +128 | +128 |
| 7 | +64 | +128 | +128 | +128 | +128 | +128 | +128 | +128 | +128 | +128 | +128 |
| 8 | +32 | +64 | +128 | +128 | +128 | +128 | +128 | +128 | +128 | +128 | +128 |
| 9 | +16 | +32 | +64 | +128 | +128 | +128 | +128 | +128 | +128 | +128 | +128 |
| 10 | +4 | +16 | +32 | +64 | +128 | +128 | +128 | +128 | +128 | +128 | +128 |
| 11 | 0 | +4 | +16 | +32 | +64 | +128 | +128 | +128 | +128 | +128 | +128 |
| 12 | +4 | 0 | +4 | +16 | +32 | +64 | +128 | +128 | +128 | +128 | +128 |
| 13 | −16 | −4 | 0 | +4 | +16 | +32 | +64 | +128 | +128 | +128 | +128 |
| 14 | −32 | −16 | −4 | 0 | +4 | +16 | +32 | +64 | +128 | +128 | +128 |
| 15 | −64 | −32 | −16 | −4 | 0 | +4 | +16 | +32 | +64 | +128 | +128 |
| 16 | −128 | −64 | −32 | −16 | −4 | 0 | +4 | +16 | +32 | +64 | +128 |
| 17 | −128 | −128 | −64 | −32 | −16 | −4 | 0 | +4 | +16 | +32 | +64 |
| 18 | −128 | −128 | −128 | −64 | −32 | −16 | −4 | 0 | +4 | +16 | +32 |
| 19 | −128 | −128 | −128 | −128 | −64 | −32 | −16 | −4 | 0 | +4 | +16 |
| 20 | −128 | −128 | −128 | −128 | −128 | −64 | −32 | −16 | −4 | 0 | +4 |
| 21 | −128 | −128 | −128 | −128 | −128 | −128 | −64 | −32 | −16 | −4 | 0 |
| 22 | −128 | −128 | −128 | −128 | −128 | −128 | −128 | −64 | −32 | −16 | −4 |
| 23 | −128 | −128 | −128 | −128 | −128 | −128 | −128 | −128 | −64 | −32 | −16 |
| 24 | −128 | −128 | −128 | −128 | −128 | −128 | −128 | −128 | −128 | −64 | −32 |
| 25 | −128 | −128 | −128 | −128 | −128 | −128 | −128 | −128 | −128 | −128 | −64 |
| 26 | −128 | −128 | −128 | −128 | −128 | −128 | −128 | −128 | −128 | −128 | −128 |
| 27 | −128 | −128 | −128 | −128 | −128 | −128 | −128 | −128 | −128 | −128 | −128 |
| 28 | −128 | −128 | −128 | −128 | −128 | −128 | −128 | −128 | −128 | −128 | −128 |
| 29 | −128 | −128 | −128 | −128 | −128 | −128 | −128 | −128 | −128 | −128 | −128 |
| 30 | −128 | −128 | −128 | −128 | −128 | −128 | −128 | −128 | −128 | −128 | −128 |
| 31 | −128 | −128 | −128 | −128 | −128 | −128 | −128 | −128 | −128 | −128 | −128 |

| | Vis | | | | | | | | | |
|---|---|---|---|---|---|---|---|---|---|---|
| POINTER | −96 | −104 | −112 | −120 | −128 | −136 | −144 | −152 | −160 | −168 |
| 0 | +128 | +128 | +128 | +128 | +128 | +128 | +128 | +128 | +128 | +128 |
| 1 | +128 | +128 | +128 | +128 | +128 | +128 | +128 | +128 | +128 | +128 |
| 2 | +128 | +128 | +128 | +128 | +128 | +128 | +128 | +128 | +128 | +128 |
| 3 | +128 | +128 | +128 | +128 | +128 | +128 | +128 | +128 | +128 | +128 |
| 4 | +128 | +128 | +128 | +128 | +128 | +128 | +128 | +128 | +128 | +128 |
| 5 | +128 | +128 | +128 | +128 | +128 | +128 | +128 | +128 | +128 | +128 |
| 6 | +128 | +128 | +128 | +128 | +128 | +128 | +128 | +128 | +128 | +128 |
| 7 | +128 | +128 | +128 | +128 | +128 | +128 | +128 | +128 | +128 | +128 |
| 8 | +128 | +128 | +128 | +128 | +128 | +128 | +128 | +128 | +128 | +128 |
| 9 | +128 | +128 | +128 | +128 | +128 | +128 | +128 | +128 | +128 | +128 |
| 10 | +128 | +128 | +128 | +128 | +128 | +128 | +128 | +128 | +128 | +128 |
| 11 | +128 | +128 | +128 | +128 | +128 | +128 | +128 | +128 | +128 | +128 |

TABLE 6-continued

| | | | | | | | | | | |
|---|---|---|---|---|---|---|---|---|---|---|
| 12 | +128 | +128 | +128 | +128 | +128 | +128 | +128 | +128 | +128 | +128 |
| 13 | +128 | +128 | +128 | +128 | +128 | +128 | +128 | +128 | +128 | +128 |
| 14 | +128 | +128 | +128 | +128 | +128 | +128 | +128 | +128 | +128 | +128 |
| 15 | +128 | +128 | +128 | +128 | +128 | +128 | +128 | +128 | +128 | +128 |
| 16 | +128 | +128 | +128 | +128 | +128 | +128 | +128 | +128 | +128 | +128 |
| 17 | +128 | +128 | +128 | +128 | +128 | +128 | +128 | +128 | +128 | +128 |
| 18 | +64 | +128 | +128 | +128 | +128 | +128 | +128 | +128 | +128 | +128 |
| 19 | +32 | +64 | +128 | +128 | +128 | +128 | +128 | +128 | +128 | +128 |
| 20 | +16 | +32 | +64 | +128 | +128 | +128 | +128 | +128 | +128 | +128 |
| 21 | +4 | +16 | +32 | +64 | +128 | +128 | +128 | +128 | +128 | +128 |
| 22 | 0 | +4 | +16 | +32 | +64 | +128 | +128 | +128 | +128 | +128 |
| 23 | −4 | 0 | +4 | +16 | +32 | +64 | +128 | +128 | +128 | +128 |
| 24 | −16 | −4 | 0 | +4 | +16 | +32 | +64 | +128 | +128 | +128 |
| 25 | −32 | −16 | −4 | 0 | +4 | +16 | +32 | +64 | +128 | +128 |
| 26 | −64 | −32 | −16 | −4 | 0 | +4 | +16 | +32 | +64 | +128 |
| 27 | −128 | −64 | −32 | −16 | −4 | 0 | +4 | +16 | +32 | +64 |
| 28 | −128 | −128 | −64 | −32 | −16 | −4 | 0 | +4 | +16 | +32 |
| 29 | −128 | −128 | −128 | −64 | −32 | −16 | −4 | 0 | +4 | +16 |
| 30 | −128 | −128 | −128 | −128 | −64 | −32 | −16 | −4 | 0 | +4 |
| 31 | −128 | −128 | −128 | −128 | −128 | −64 | −32 | −16 | −4 | 0 |

Figure 22:
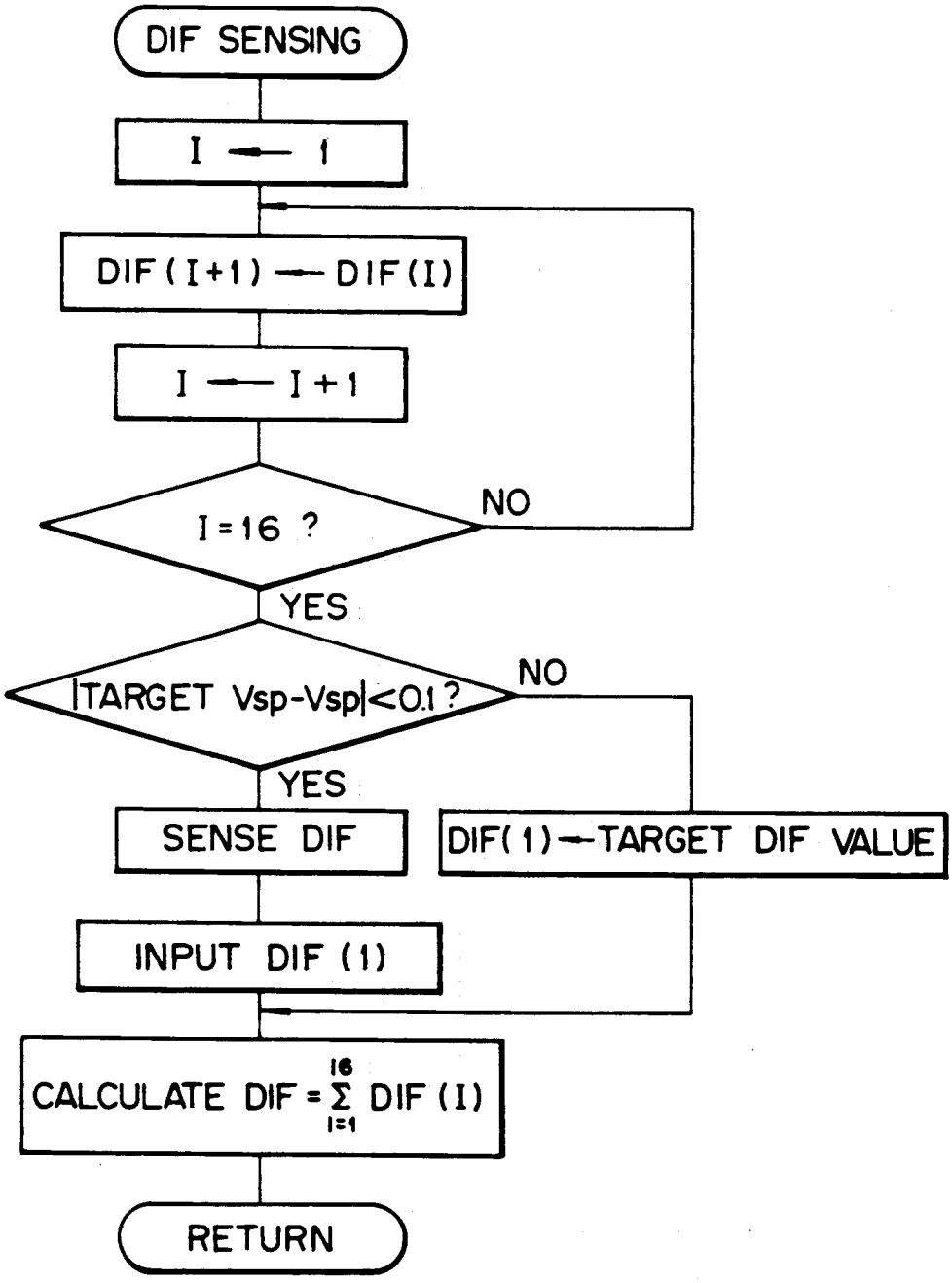

As shown in FIG. 22, DIF detection in the above-stated DIF control consists in updating the above-mentioned Vll—Vlh, updating the initial value, determining whether or not the detection has completed with all of the tones, producing, if the answer is positive, a difference between the detected value associated with the toner pattern and the target value, and determining a relation between the difference and the predetermined value. If the difference is smaller than the predetermined value, the CPU 100A inputs the data determining that DIF detection has completed, sums the output data, and then uses the sum to set a pointer for DIF control.

Figure 23:
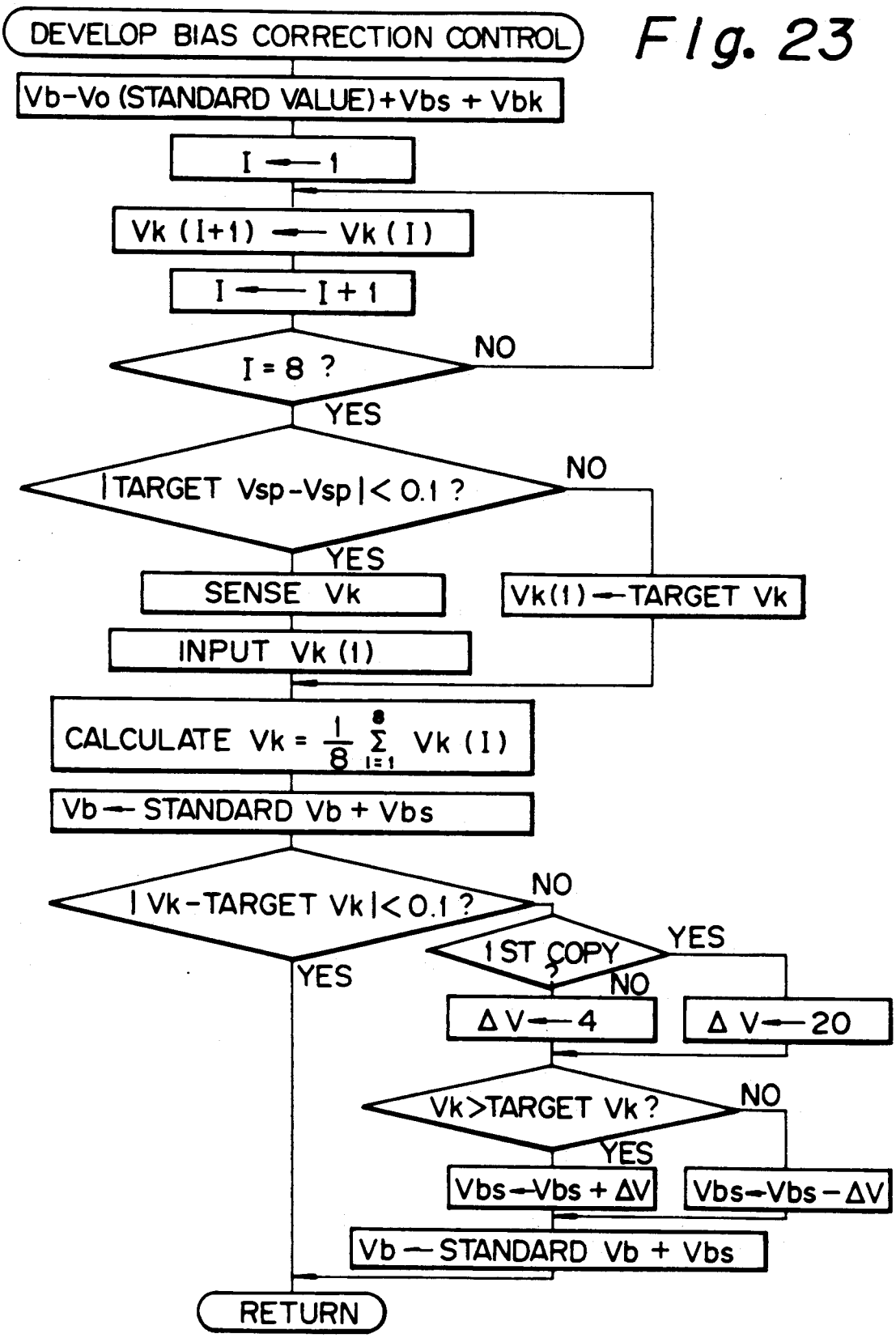

After the CPU 100A has determined a shift of developing bias by the Vbs control or a correction amount of charge potential by the DIF control, it selects a standard developing bias, a standard charge potential and a standard amount of exposing light in a pointer table, FIG. 17. Then, the CPU 100A corrects the standard values to effective values. Subsequently, the charger and the drive section associated with the developing sleeve are turned on while, at the same time, the photoconductive element is driven to from an image thereon. The photosensor senses the density of the resultant toner pattern on the photoconductive element to allow the developing bias to be corrected. Specifically, so-called Vk control is executed. Since the Vk control has been stated previously, only a flowchart representative of such control is shown in FIG. 23.

Figures 24, 24A:
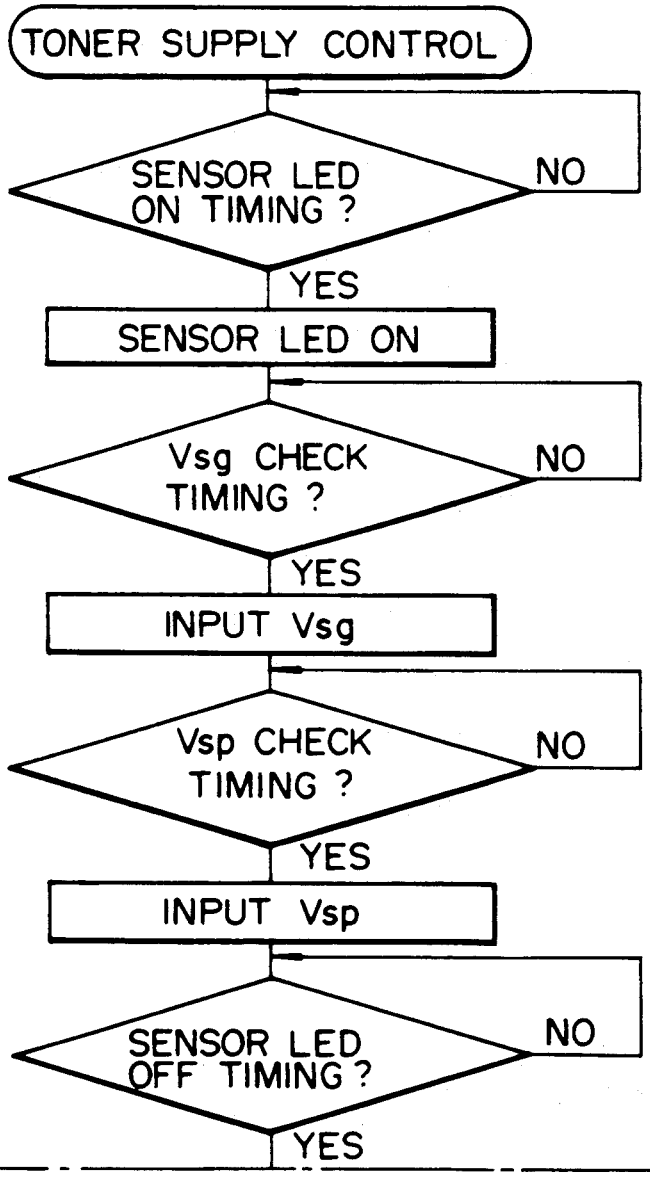
Figure 24B:
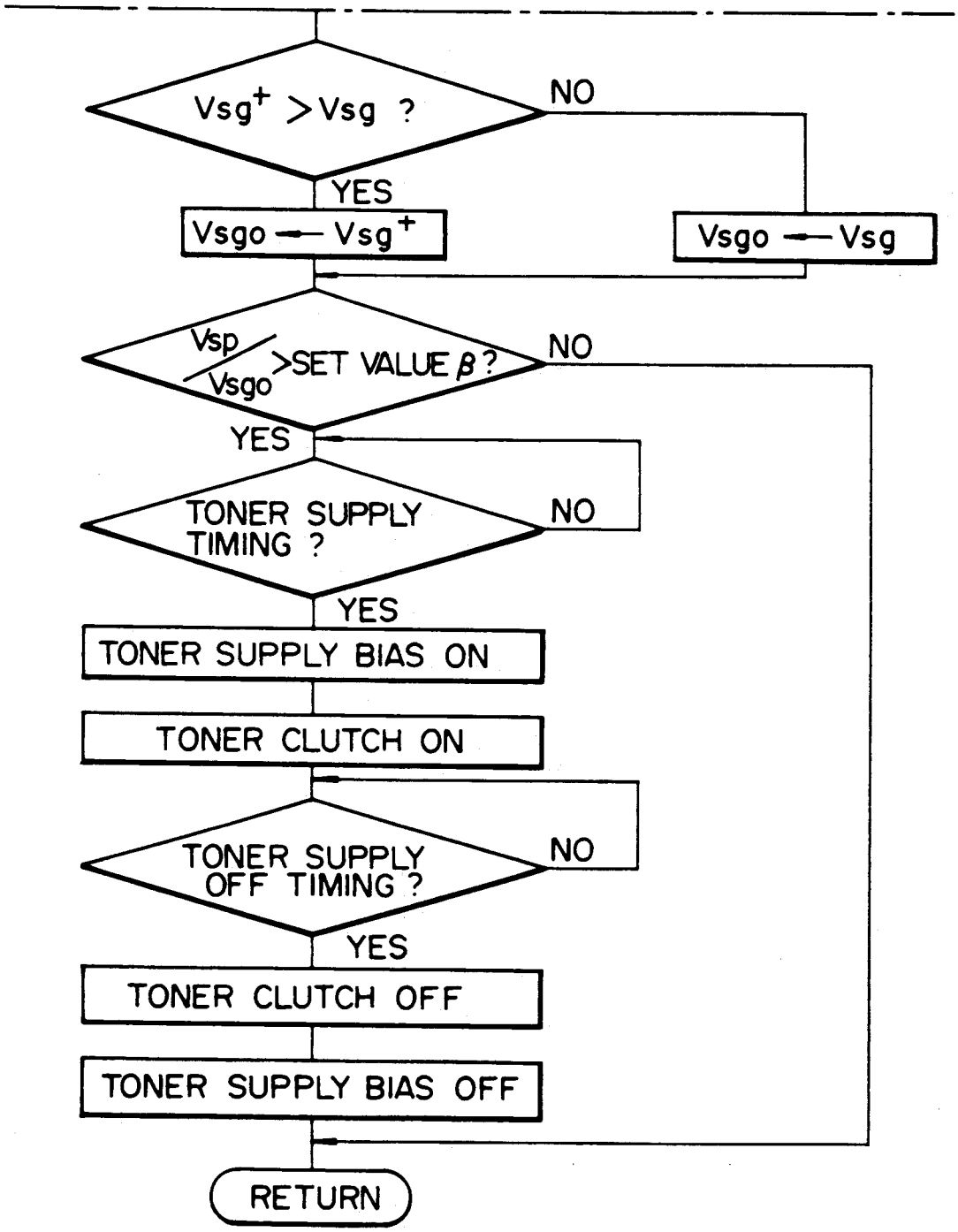

As shown in FIG. 24, the CPU 100A starts on the toner supply control by determining whether or not the time for the photosensor to operate has been reached, i.e., whether or not the photosensor has faced the background of the photoconductive element. If the answer of this decision is positive, the CPU 100A detects the background potential Vsg of the photoconductive element via the photosensor and the density (Vsp) of the toner image pattern having formed on the background by an ordinary image forming procedure. The CPU 100A compares the instantaneous background potential with the mean background potential and, based on the result of comparison, updates the initial value of the background potential. Then, the CPU 100A compares the updated background potential with the potential of the toner image pattern. If the ratio of the background potential and toner image pattern is greater than a predetermined one, i.e., if the density of the toner image pattern is low, the CPU 100A executes processing for starting on the supply of toner.

The sequence of steps described above is continuously executed while the copying cycle is reported, as shown in FIG. 16.

Further, in the illustrative embodiment, the CPU 100A determines whether or not the quantity of exposing light is adequate as measured on the photoconductive element and, if it is adequate, performs the toner density control by controlling the dynamic range on the basis of the sensed density of the toner image pattern, as stated above. Specifically, assume that a toner image is formed on the photoconductive element by, for example, the relative "3" of exposing energy shown in FIG. 15 and which renders a tone of medium density. The CPU 100A executes density control which will be described only if the difference between the surface potential of the photoconductive element, i.e., the background potential (Vo) and the potential (Vl) representative of the density of the above-mentioned toner image lies in a predetermined range (±20 V) with respect to a target value.

Figure 25:
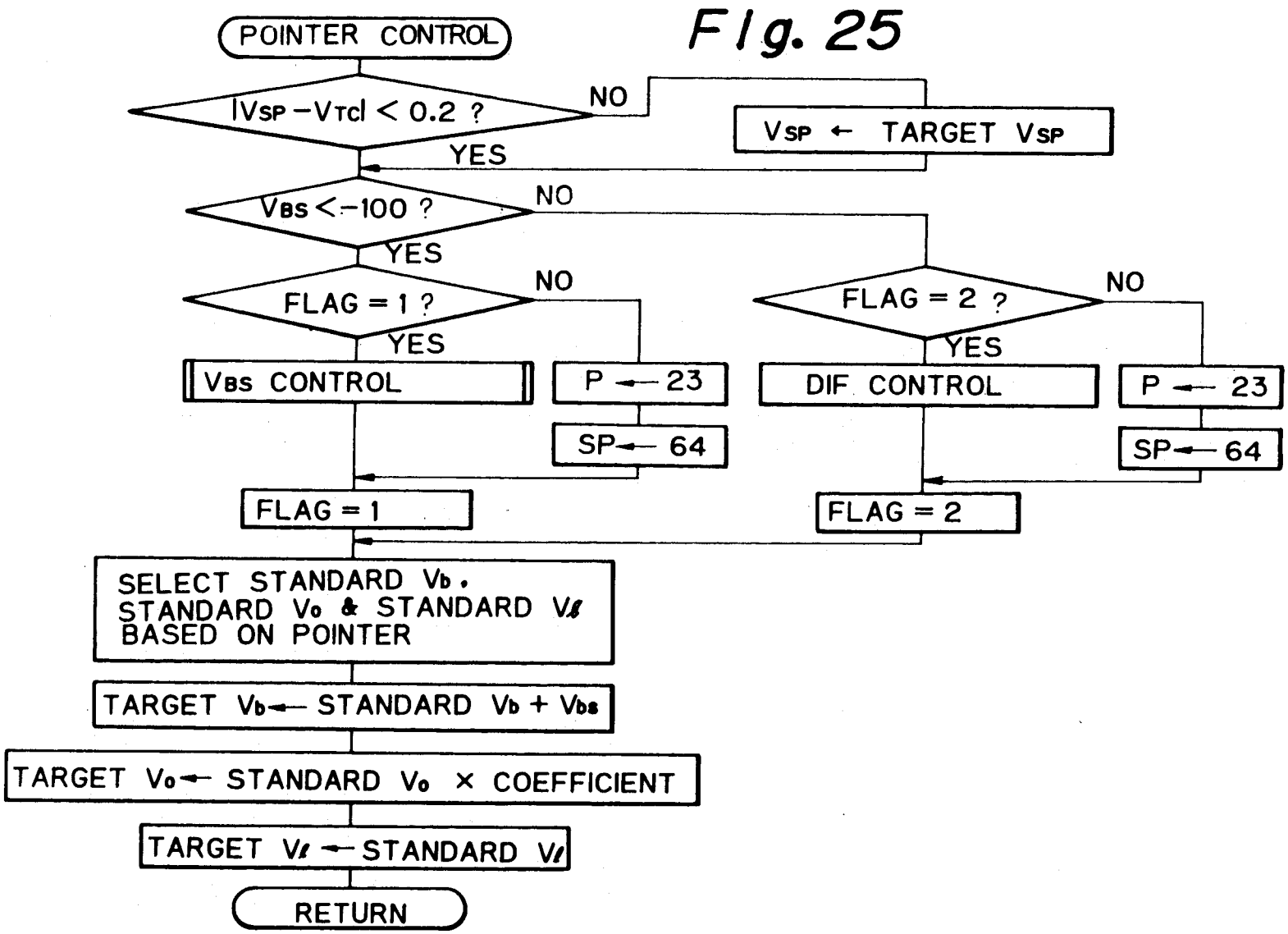

In detail, in the sequence control shown in FIG. 16, the CPU 100A sequentially determines whether or not the power switch and the print switch have been turned on and then selects a dynamic range for forming an image by pointer control. As shown in FIG. 25, the CPU 100A starts on the pointer control by determining whether or not the difference between the output (Vsp) representative of the density of the toner image pattern and the target output (Vtc) of the toner image pattern for toner density control is greater than 0.2 V, for example. If the answer of this decision is positive, the CPU 100A substitutes a value corresponding to the target density for the density output (Vsp) determining that the dynamic range or the shift of developing bias is excessive. Thereafter, the operation is transferred to the previously stated DIF control or the Vbs control. On completing the decision on the density of the toner image pattern, the CPU 100A determines whether or not the correction of the shift of developing bias is greater than a predetermined value and, based on the result of decision, executes processing for correcting the toner density by the Vbs control or the DIF control.

In summary, the present invention controls the toner supply to a developer in response to the output of an optical sensor responsive to at least two kinds of toner image patterns which are formed on a photoconductive element, together with the dynamic range for electrostatically forming a latent image on the photoconductive element. Specifically, the present invention executes such control by shifting the developing bias such that the amount of toner deposition on the photoconductive element becomes constant, comparing the resulted shift with a reference value, and, based on the result of comparison, variably controls the dynamic range in matching relation to a potential difference between the toner image patterns or variably controls the dynamic range in matching relation to the shift of developing bias. Therefore, the dynamic range for development can be immediately corrected even when the ambient conditions are sharply changed. By checking the shift of developing bias, it is possible to determine the direction of the shift and, therefore, to prevent the toner density from running out of control when the output of the photosensor is maintained constant.

More accurate density control is achievable if whether or the current dynamic range associated with image forming matches the ambient conditions is determined and if they are corrected, as needed.

Further, when the voltage representative of the background changes due to contamination which occurred while a developing sleeve was in a halt, the present invention controls the dynamic range as well as the toner supply on the basis of the voltage which was detected while the developing sleeve was in operation. This prevents the toner density from uncontrollably increasing due to excessive toner supply which is apt to occur when the toner density is corrected on the basis of the above-mentioned changed voltage representative of the background and the voltage representative of the toner image pattern.

When the present invention detects the density of the exclusive toner image pattern for toner density control, it determines whether or not the amount of exposing light which is one condition for density dection is adequate and, only if it is adequate, detects the density of the toner image pattern. If the density of the toner image pattern does not correspond to a target density, i.e., the former differs from the latter by an unusual degree, the toner density control matching the detected value is not effected at all. This is successful in preventing the dynamic range from varying over a broader range during image forming operation which would increase the time necessary for the actual density to reach the target density. The broader range of variation would also cause the dynamic range to effect the subsequence correction and thereby make adequate toner density control impossible.

Moreover, by making maintaining the conditions for density detection appropriate, the present invebtion insures accurate parameters which are necessary for the control over the dynamic range particular to toner density control.

Various modifications will become possible for those skilled in the art after receiving the teachings of the present disclosure without departing from the scope thereof.

What is claimed is:

1. Image forming equipment for electrostatically forming a latent image on an image carrier and developing said latent image by a developer containing at least a toner to produce a corresponding toner image on said image carrier, said equipment comprising:

photosensor means for sensing a reflection from a predetermined toner image pattern formed on said image carrier;

first and second variable dynamic range control means responsive to an output signal of said photosensor means for varying at least one of a developing bias, a charge potential and an amount of exposure to thereby variably control a dynamic range which is a difference between the maximum and minimum values of a surface potential of said image carrier;

outputting means for outputting an information value relating to an amount of toner deposition on said image carrier which varies with a variation in an ambient condition;

comparing means for comparing said information value with a reference value which defines a first environment and a second environment; and switching means responsive to an output of said comparing means for selecting either one of said first and second variable dynamic range control means which are optimal for said first and second environments, respectively.

2. Equipment as claimed in claim 1, wherein said information value comprises a shift (Vbs) of the developing bias, said first variable dynamic range control means controlling said Vbs, said second variable dynamic range control means effecting DIF control for controlling a difference (DIF) between the output of said photosensor means associated with a line pattern having medium density and the output of said photosensor means associated with a line pattern having maximum density.

3. Equipment as claimed in claim 2, wherein said Vbs control is effected when said Vbs is smaller than a predetermined value while said DIF control is effected when said Vbs is greater than said predetermined value.

4. Equipment as claimed in claim 2, wherein when the amount of toner supply to the developer and the dynamic range for electrostatically forming a latent image on said image carrier are to be controlled in combination in response to the output signal of said photosensor means, said Vbs control shifts the developing bias such that the amount of toner deposition on said image carrier becomes constant and, based on the resulted shift, variably controls said dynamic range.

5. Equipment as claimed in claim 2, wherein said DIF control uniformly charges the surface of said image carrier by a predetermined surface potential, electrostatically forms a latent image on said image carrier by illuminating said image carrier, develops a toner image pattern by developing said latent image, senses toner densities each being associated with respective one of at least two toner image patterns formed on said image carrier so as to determine the amount of toner deposited on respective one of said toner image patterns, and variably controls the amount of toner supply and the dynamic range which is a difference between the maximum and minimum values of the surface potential of said latent image for electrostatically forming a latent image such that the difference between the densities of said two toner image patterns reaches a predetermined value.

6. Equipment as claimed in claim 5, wherein said DIF control determines whether or not the amount of exposure is adequate by determining whether or not a difference between the surface potential of said image carrier and a potential representative of the density of a toner image having been formed by a predetermined density adjustment lies in a predetermined range with respect to a target value, and controls, if said amount of exposure is adequate and if a difference between the output signal of said photosensor means responsive to a toner supply control pattern and a predetermined reference output is smaller than a predetermined value, at least one of a charge potential, a developing bias and an amount of exposure relating to the formation of an image in response to the output signals of said photosensor associated with at least two of said toner image patterns.

7. Equipment as claimed in claim 5, wherein said DIF control senses the densities of two patterns a plurality of times and produces the running mean of sensed densities.

8. Equipment as claimed in claim 4, further comprising means for determining a pointer on the basis of said Vbs, and means for determining a charge potential, a developing bias and an amount of exposure matching said pointer, said dynamic range being variably controlled in response to decisions of said two means for determining.

9. Equipment as claimed in claim 5, further comprising means for determining a pointer on the basis of said DIF value, and means for determining a charge potential, a developing bias and an amount of exposure matching said pointer, said dynamic range being variably controlled in response to decisions of said two means for determining.

10. Image forming equipment for electrostatically forming a latent image on an image carrier and developing said latent image by a developer containing at least a toner to produce a corresponding toner image on said image carrier, said equipment comprising:

photosensor means for sensing a reflection from a predetermined toner image pattern formed on said image carrier; and control means responsive to an output signal of said photosensor means for varying at least one of a developing bias, a charge potential, and an amount of exposure;

said control means shifting, when an amount of toner supply to the developer and a dynamic range for electrostatically forming a latent image on said image carrier are to be controlled in combination in response to the output signal of said photosensor means, the developing bias such that the amount of toner deposition on said image carrier becomes constant and, based on the resulted shift, variably controlling said dynamic range.

11. Image forming equipment for electrostatically forming a latent image on an image carrier and developing said latent image by a developer containing at least a toner to produce a corresponding toner image on said image carrier, said equipment comprising:

photosensor means for sensing a reflection from a predetermined toner image pattern formed on said image carrier; and control means responsive to an output signal of said photosensor means for varying at least one of a developing bias, a charge potential, and an amount of exposure;

said control means determining whether or not the amount of exposure is adequate by determining whether or not a difference between a surface potential of said image carrier and a potential representative of a density of a toner image having been formed by a predetermined density adjustment lies in a predetermined range with respect to a target value, and controls, if the amount of exposure is adequate and if a difference between the output signal of said photosensor means responsive to a toner supply control pattern and a predetermined reference output is smaller than a predetermined value, at least one of a charge potential, a developing bias and an amount of exposure relating to the formation of an image in response to the output signals of said photosensor means associated with at least two of said toner image patterns while, if said difference is greater than said predetermined value, controlling at least one of said charge potential, said developing bias and said amount of exposure in matching relation to a target density.

* * * * *